US008025512B2

(12) United States Patent
Aoki et al.

(10) Patent No.: US 8,025,512 B2
(45) Date of Patent: Sep. 27, 2011

(54) OBJECT FITTING/REMOVING DRIVE UNIT, AND CONNECTOR UNIT

(75) Inventors: Shigeharu Aoki, Tokyo (JP); Masahiro Yamauchi, Tokyo (JP); Keisuke Nakayama, Yamanashi (JP)

(73) Assignees: Japan Aviation Electronics Industry Limited, Tokyo (JP); NEC Corporation, Tokyo (JP)

( * ) Notice: Subject to any disclaimer, the term of this patent is extended or adjusted under 35 U.S.C. 154(b) by 293 days.

(21) Appl. No.: 12/482,794

(22) Filed: Jun. 11, 2009

(65) Prior Publication Data

US 2009/0317992 A1 Dec. 24, 2009

(30) Foreign Application Priority Data

Jun. 20, 2008 (JP) ..... 2008-162257

(51) Int. Cl.
*H01R 13/62* (2006.01)

(52) U.S. Cl. ..... 439/157; 439/259

(58) Field of Classification Search ..... 439/157, 439/259, 261, 610

See application file for complete search history.

(56) References Cited

U.S. PATENT DOCUMENTS 6,019,619 A * 2/2000 Aoki et al. ..... 439/157
6,036,509 A * 3/2000 Maejima ..... 439/157
6,979,213 B1 * 12/2005 Mauney et al. ..... 439/157

FOREIGN PATENT DOCUMENTS

JP 2002-313521 A 10/2002

* cited by examiner

*Primary Examiner* — Tho D Ta
*Assistant Examiner* — Travis Chambers
(74) *Attorney, Agent, or Firm* — Holtz, Holtz, Goodman & Chick, PC

(57) ABSTRACT

An object fitting/removing drive unit capable of fitting objects to each other, even if there is not enough working space in a fitting/removing direction of one object. Operation members holding cable connectors are accommodated in an inner frame in a manner movable in the fitting/removing direction. The inner frame is movably supported by outer frames along a direction orthogonal to the fitting/removing direction between initial and fitting-completed positions. A coupling member engaged with header connectors is movably supported by the outer frames along a direction orthogonal to the fitting/removing direction. When the inner frame is moved from the initial position to the fitting-completed position by being pressed by the coupling member, the outer frames guide the operation members toward the header connectors to fit the cable connectors and the header connectors to each other. A drive force transferring unit transfers driving force in the orthogonal direction.

8 Claims, 37 Drawing Sheets

OBJECT FITTING/REMOVING DRIVE UNIT, AND CONNECTOR UNIT

BACKGROUND OF THE INVENTION

2. Field of the Invention

This invention relates to an object fitting/removing drive unit for fitting and removing objects to be connected to and from each other.

2. Description of the Related Art

Conventionally, there has been proposed a connector drive unit for fitting and removing connectors to and from each other (see Japanese Laid-Open Patent Publication (Kokai) No. 2002-313521).

This connector drive unit is comprised of operation frames each holding one connector (cable connector), an operation frame-accommodating body which slidably accommodates the operation frames, sliders which drive the operation frames, and locks which restrict sliding of the operation frames.

Each operation frame includes connector holding portions, driven portions, and engaging portions engaged with associated one of the locks.

Each slider includes a lock-moving cam groove for moving the locks, and an operation frame-driving cam groove for driving the driven portions.

In this connector drive unit, it is possible to fit and remove the connectors which are disposed opposed to each other within the operation frame-accommodating body by sliding the sliders.

In the case of the above-described connector drive unit, it is necessary to mount a printed circuit board on which the other connector (header connector) is mounted on the operation frame accommodating member from a connector fitting direction. However, if there is not enough working space in the connector fitting direction of the operation frame accommodating member, it is impossible to mount the printed circuit board on the operation frame accommodating member, which makes it impossible to fit the connectors to each other.

SUMMARY OF THE INVENTION

The present invention has been made in view of these circumstances, and an object thereof is to provide an object fitting/removing drive unit and a connector unit which are capable of fitting objects to be connected to each other, even if there is not enough working space in a fitting/removing direction of one object to be connected.

To attain the above object, in a first aspect of the present invention, there is provided an object fitting/removing drive unit for fitting and removing one object to be connected and another object to be connected to and from each other, comprising at least one operation member that has a holding frame which holds the one object to be connected, a coupling member which is coupled with the other object to be connected, an inner frame that accommodates the operation member in a manner movable in a fitting/removing direction, an outer frame that supports the inner frame along a direction which is orthogonal to the fitting/removing direction in a manner movable between an initial position and a fitting-completed position, and supports the coupling member in a manner movable along the direction which is orthogonal to the fitting/removing direction, for guiding the operation member toward the other object to be connected to fit the one object to be connected to the other object to be connected, when the inner frame is moved from the initial position to the fitting-completed position by being pushed by the coupling member, and driving force-transferring means for transferring a driving force in the direction which is orthogonal to the fitting/removing direction, to the inner frame.

With the arrangement of the object fitting/removing drive unit according to the first aspect of the present invention, the outer frame supports the inner frame in a manner movable between the initial position and the fitting-completed position along the direction which is orthogonal to the fitting/removing direction, and at the same time supports the coupling member which is coupled with the other object to be connected in a manner movable along the direction which is orthogonal to the fitting/removing direction, whereby when the inner frame is pressed by the coupling member, to be moved from the initial position to the fitting-completed position, the outer frame guides the operation member toward the other object to be connected to cause one object to be connected to be fitted to the other object to be connected. Therefore, it is possible to fit the objects to be connected to each other, even if there is not enough working space in the fitting/removing direction of one object to be connected.

Preferably, the outer frame includes a guide groove which guides the coupling member in a direction which is orthogonal to the fitting/removing direction.

More preferably, the object fitting/removing drive unit further comprises an abnormal fitting-prevention structure which prevents the coupling member from moving into the guide grooves, when the inner frame is not in the initial position.

Further preferably, the abnormal fitting-prevention structure comprises an opening/closing member which is provided on the outer frame, and opens/closes one end of the guide groove, and a driving member which is provided on the inner frame, and is engaged with the opening/closing member to open the one end of the guide groove when the inner frame is in the initial position, and is disengaged from the opening/closing member to close the one end of the guide groove when the inner frame is not in the initial position.

To attain the above object, in a second aspect of the present invention, there is provided a connector unit having one connector, another connector which is capable of being fitted to the one connector, and an object fitting/removing drive unit for fitting/removing both the connectors comprising at least one operation member that has a holding frame which holds the one connector, a coupling member which is coupled with the other connector, an inner frame for accommodating the operation member movably in the fitting/removing direction, an inner frame that accommodates the operation member in a manner movable in a fitting/removing direction, an outer frame that supports the inner frame along a direction which is orthogonal to the fitting/removing direction in a manner movable between an initial position and a fitting-completed position, and supports the coupling member in a manner movable along the direction which is orthogonal to the fitting/removing direction, for guiding the operation member toward the other connector to fit the one connector to the other connector, when the inner frame is moved from the initial position to the fitting-completed position, and driving force-transferring means for transferring a driving force in the direction which is orthogonal to the fitting/removing direction, to the inner frame.

Preferably, the outer frame includes a guide groove for guiding the coupling member in a direction which is orthogonal to the fitting/removing direction.

More preferably, the connector unit further comprises an abnormal fitting-prevention structure which prevents the coupling member from moving into the guide grooves, when the inner frame is not in the initial position.

Further preferably, the abnormal fitting-prevention structure comprises an opening/closing member which is provided on the outer frame, and opens/closes one end of the guide groove, and a driving member which is provided on the inner frame, and is engaged with the opening/closing member to open the one end of the guide groove when the inner frame is in the initial position, and is disengaged from the opening/closing member to close the one end of the guide groove when the inner frame is not in the initial position.

According to this invention, it is possible to fit the objects to be connected to each other, even if there is not enough working space in the fitting/removing direction of one object to be connected.

The above and other objects, features and advantages of the present invention will become more apparent from the following detailed description taken in conjunction with the accompanying drawings.

DETAILED DESCRIPTION OF THE PREFERRED EMBODIMENTS

The present invention will now be described in detail with reference to the drawings showing preferred embodiments thereof.

Figure 1:
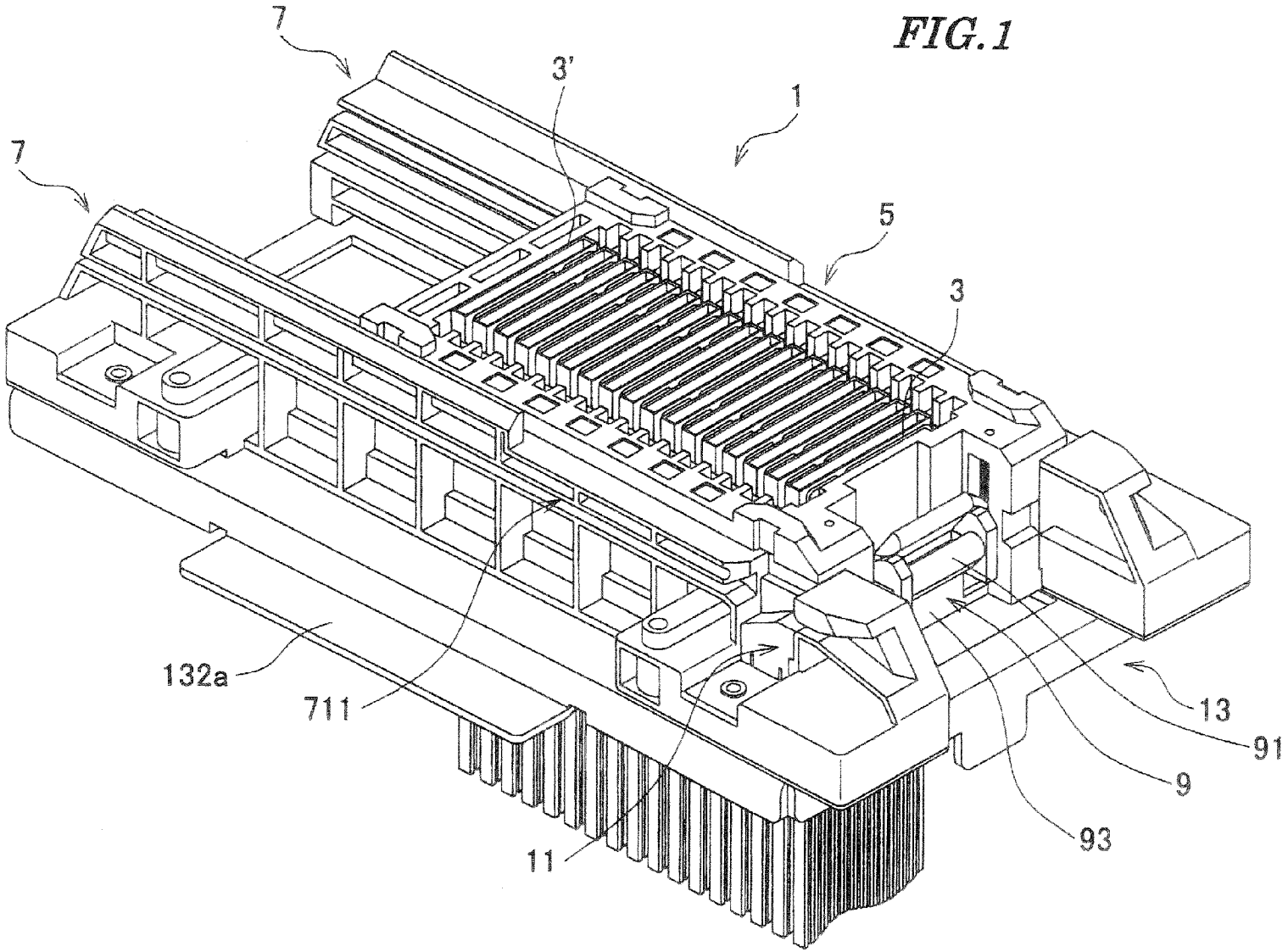
FIG. 1 is a perspective view of an object fitting/removing drive unit according to an embodiment of the present invention.
Figure 8A:
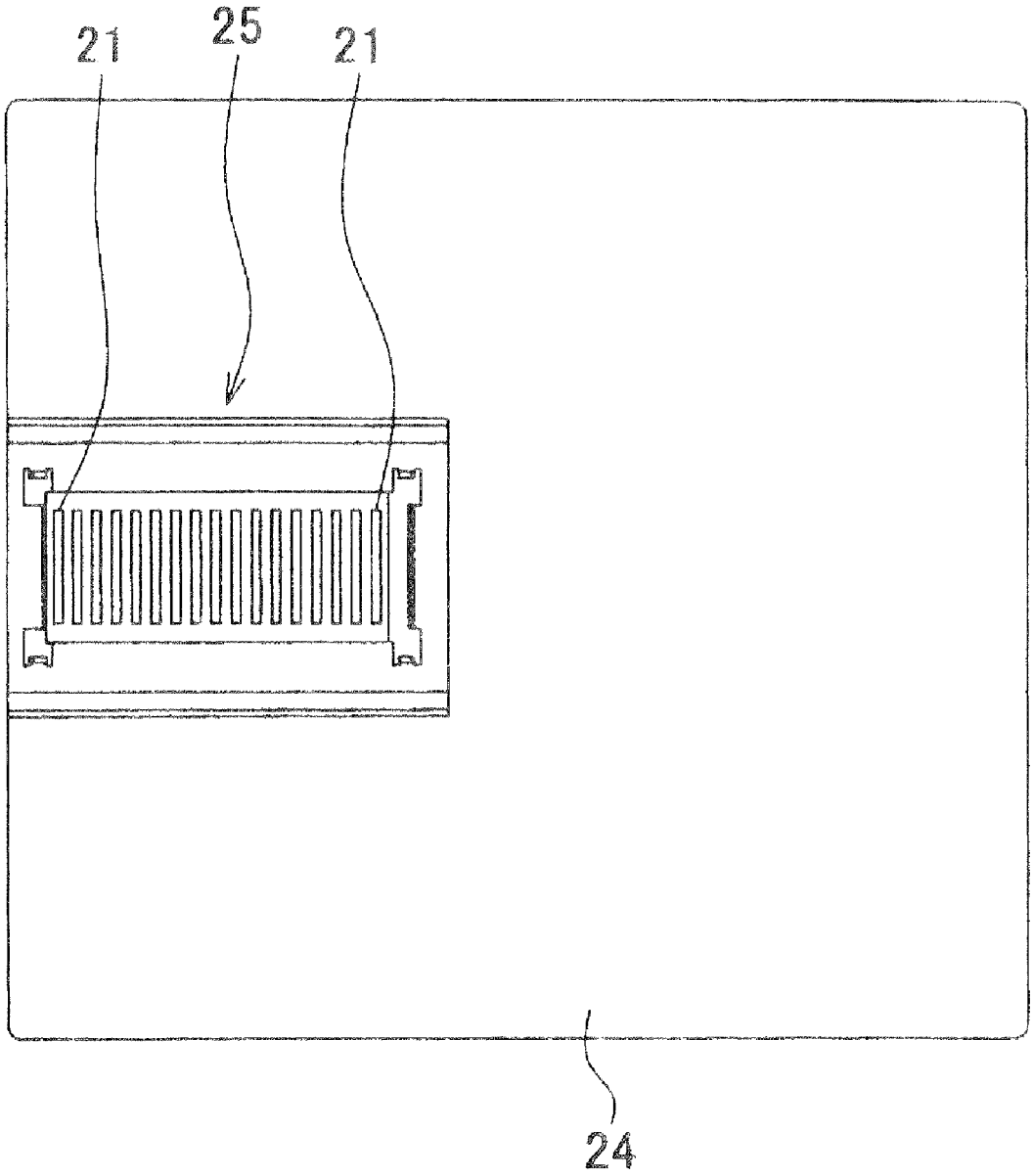
FIG. 8A is a plan view of a substrate on which a coupling member and header connectors are mounted.
Figure 8B:
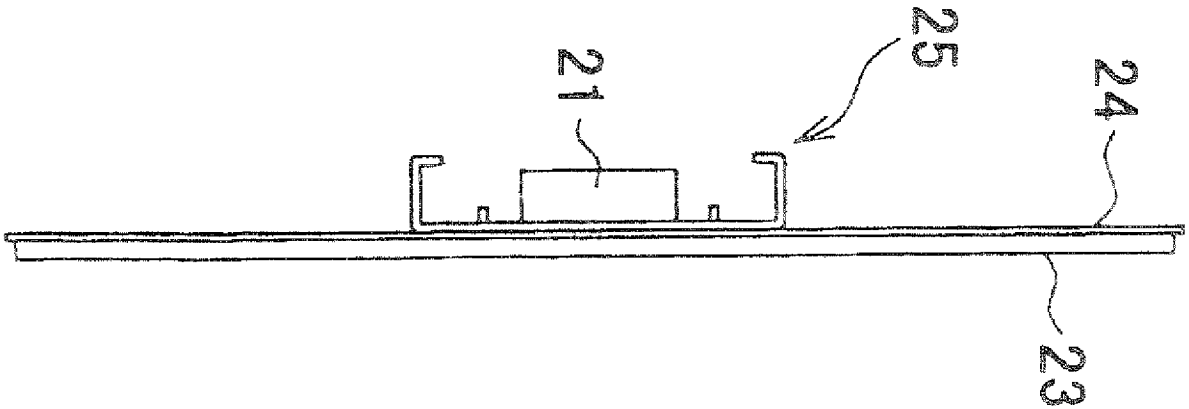
FIG. 8B is a front view of the same.

Referring first to FIGS. 1, 8A, and 8B, an object fitting/removing drive unit 1 is a unit for fitting and removing cable connectors (one object to be connected) 15 (see FIGS. 20 and 25) which are held by an inner frame 5 and header connectors (another object to be connected) 21 which are mounted on a substrate 23 to and from each other.

Figure 2:
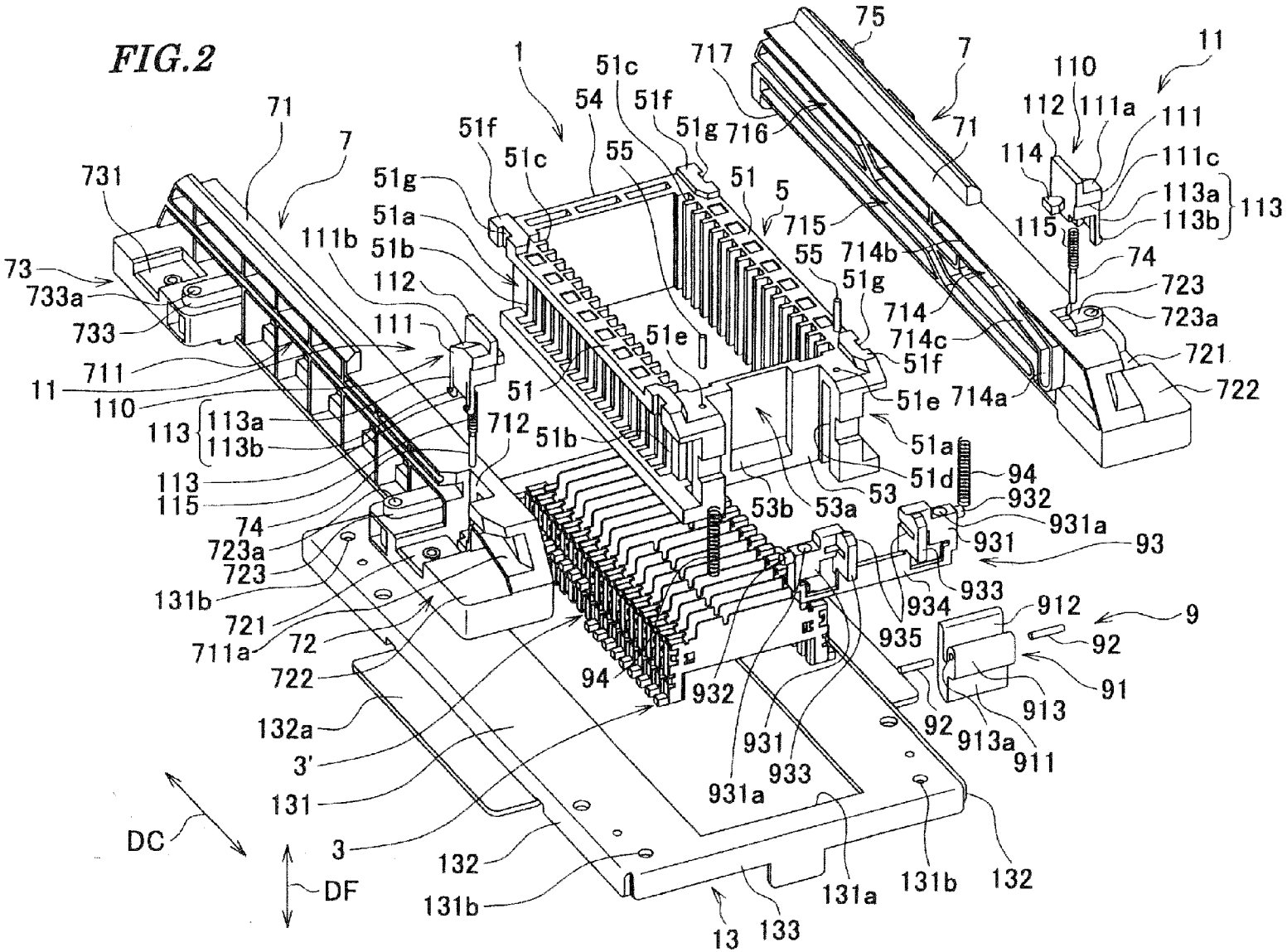
FIG. 2 is an exploded perspective view of the object fitting/removing drive unit shown in FIG. 1.

As shown in FIG. 2, the object fitting/removing drive unit 1 is comprised of first and second operation members 3 and 3', the inner frame 5, a pair of outer frames 7, a drive force transfer device (drive force transferring means) 9, abnormal fitting prevention devices (abnormal fitting-prevention structure) 11, and a base plate 13.

Figure 3A:
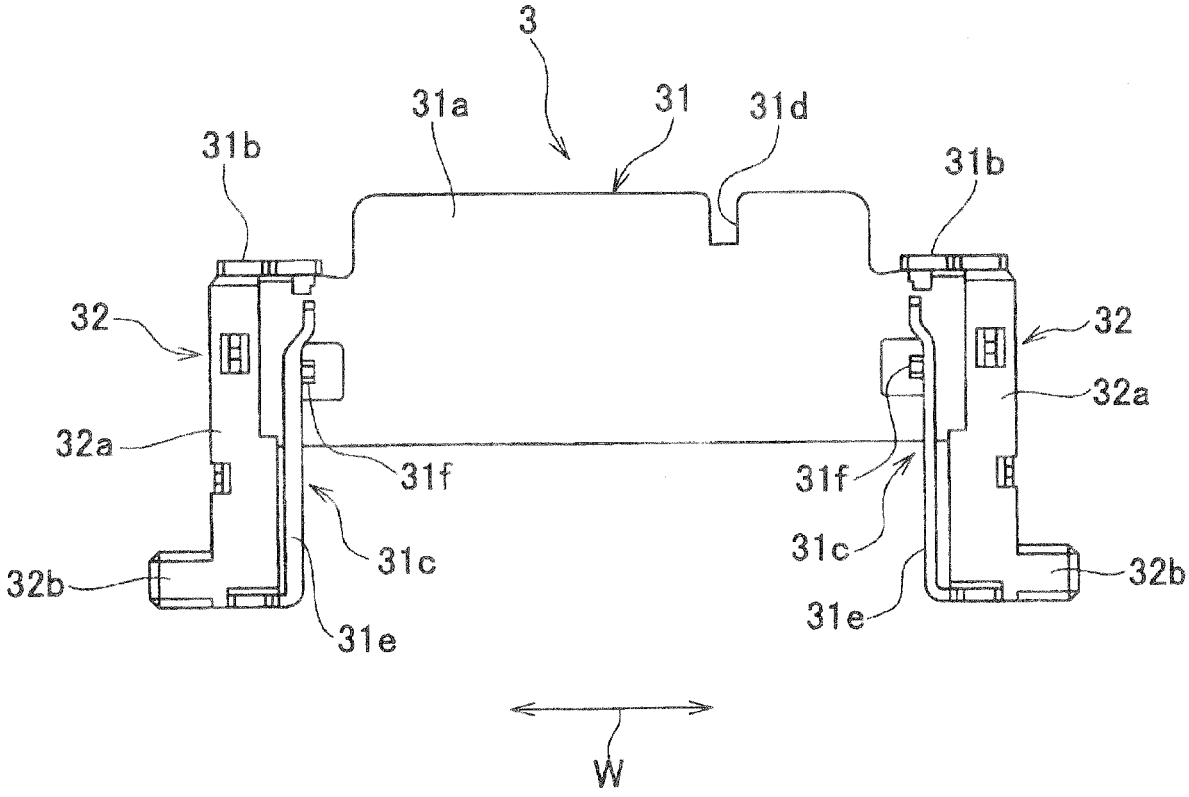
FIG. 3A is a front view of a first operation member of the object fitting/removing drive unit shown in FIG. 1.
Figure 3B:
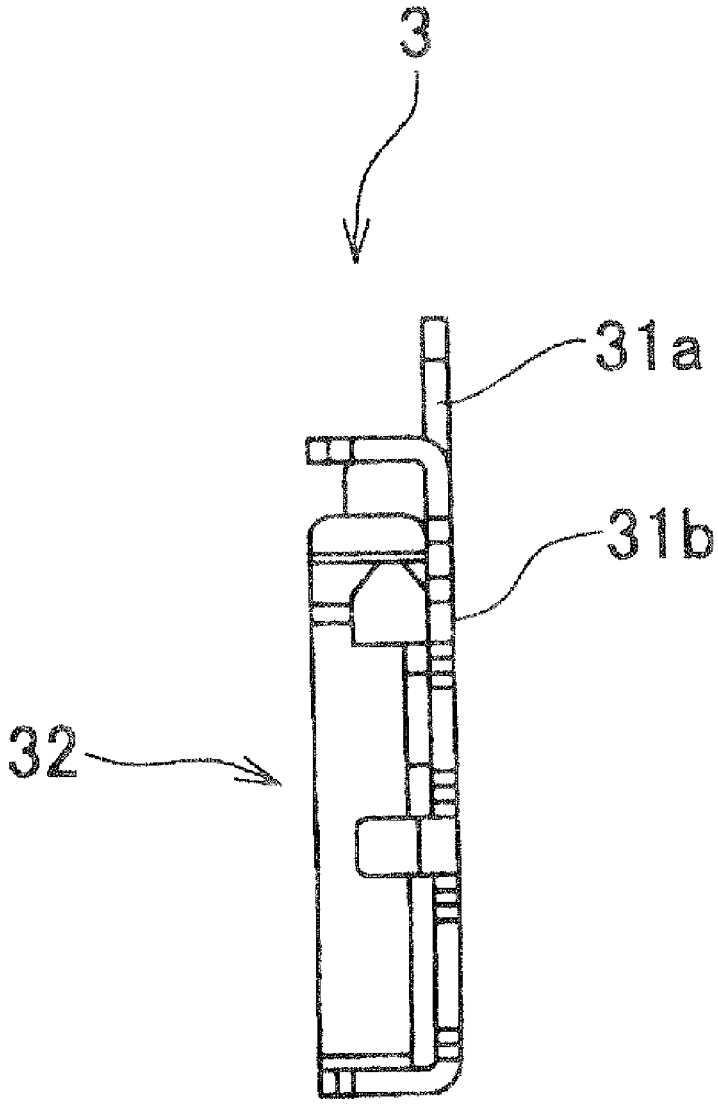
FIG. 3B is a side view of the first operation member.

As shown in FIGS. 3A and 3B, each of the first operation members 3 is formed by a holding frame 31 and a pair of mold bosses 32.

The holding frame 31 is formed by blanking and bending a metal plate. The holding frame 31 includes a plate portion 31*a*, a pair of fixing portions 31*b*, and a pair of locking portions 31*c*.

The plate portion 31*a* has an upper part formed with a cutout 31*d*. The cutout 31*d* is a mark that makes the first operation member 3 distinguishable from the second operation member 3'.

The pair of the fixing portions 31*b* are connected to opposite sides of the plate portion 31*a*, respectively. The mold bosses 32 are fixed to the fixing portions 31*b*, respectively.

The pair of locking portions 31*c* are opposed to each other in a direction of the width W of the cable connector 15. Each locking portion 31*c* is comprised of a spring portion 31*e* and a lug portion 31*f*. The spring portion 31*e* is connected to a lower end of the fixing portion 31*b*. The lug portion 31*f* is continuous with an upper portion of the spring portion 31*e*, and protrudes in the direction of the width W. The pair of locking portions 31*c* lock and hold an associated cable connector 15 disposed therebetween in a sandwiching manner.

Each mold boss 32 is made of a synthetic resin, and is connected to the holding frame 31 by press-fitting. The mold boss 32 includes a fixing portion 32*a* and a boss 32*b*. The fixing portion 32*a* is fixed to the fixing portion 31*b* of the holding frame 31. The boss 32*b* is continuous with the fixing portion 32*a*, and protrudes in the direction of the width W.

Figure 4A:
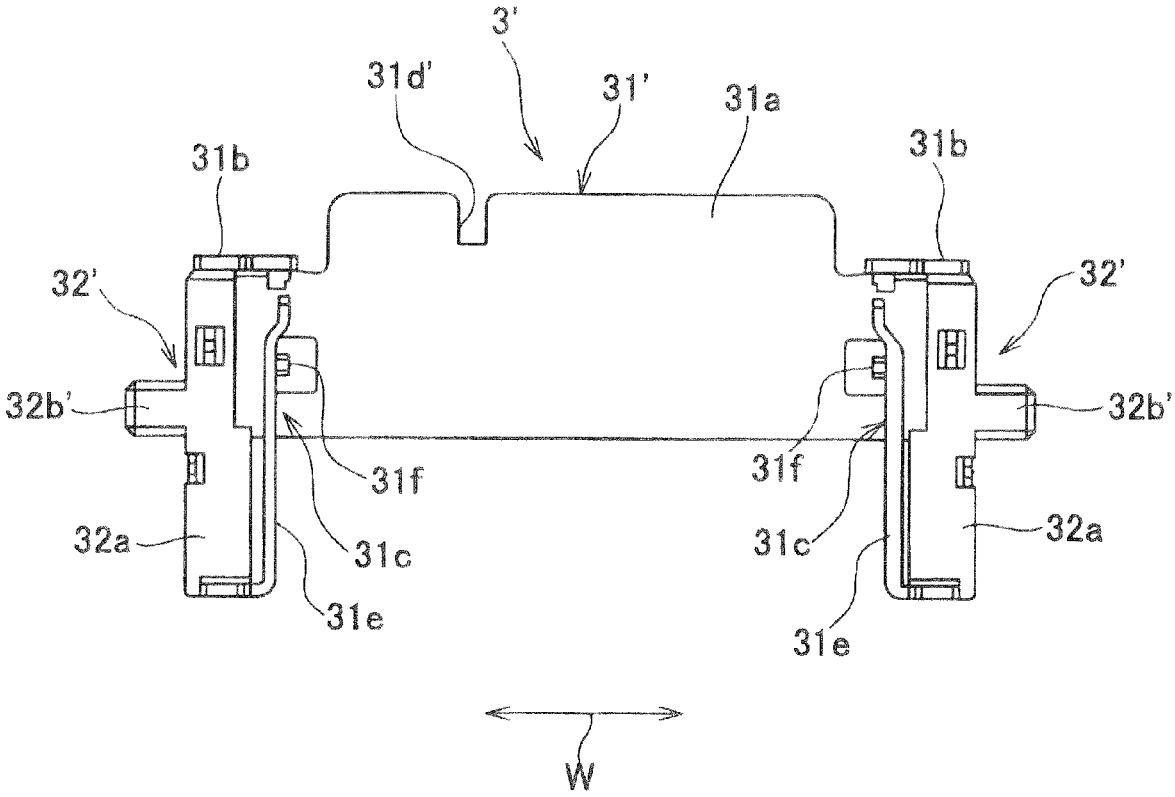
FIG. 4A is a front view of a second operation member of the object fitting/removing drive unit shown in FIG. 1.
Figure 4B:
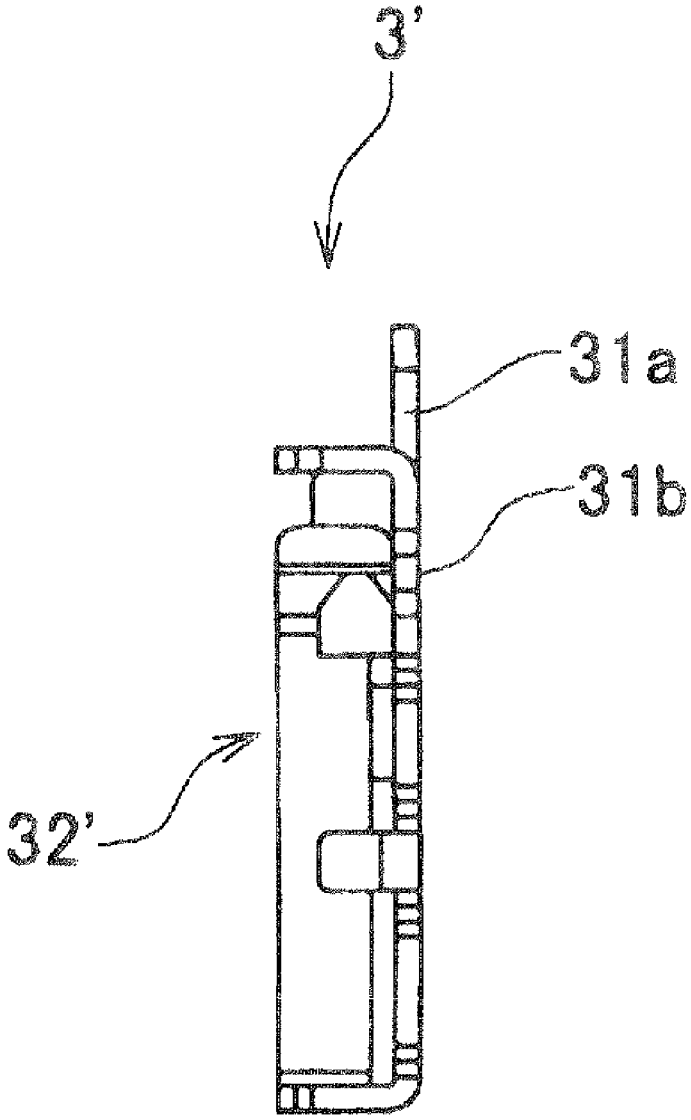
FIG. 4B is a side view of the second operation member.

As shown in FIGS. 4A and 4B, each second operation member 3' is comprised of a holding frame 31' and a pair of mold bosses 32'. There is no difference between the portions of the holding frame 31 and the portions of the holding frame 31' except that the position of a cutout 31*d'* of the holding frame 31' is different from the position of the cutout 31*d* of the holding frame 31. Therefore, the portions of the holding frame 31' are denoted by the same reference numerals as those for the corresponding portions of the holding frame 31, respectively, and description of the holding frame 3' is omitted. There is no difference between the portions of each mold boss 32 and the portions of each mold boss 32' except that the position of a boss 32*b'* of the mold boss 32' is different from the position of the boss 32*b* of the mold boss 32. Therefore, the portions of the mold boss 32' are denoted by the same reference numerals as those for the corresponding portions of the mold boss 32 and description of the mold boss 32' is omitted.

As shown in FIG. 2, the inner frame 5 is substantially frame-shaped, and is made of a synthetic resin. The inner frame 5 is formed by four side walls 51, 51, 53, and 54.

The side walls 51 and 51 extend along a connector arranging direction DC (direction which is orthogonal to a fitting/removing direction DF) of the cable connectors 15. The side walls 51 and 51 are parallel to each other. Each side wall 51 has an outer surface formed with a recess 51*a*. The recess 51*a* extends in the connector arranging direction DC. In the recess 51*a*, a frame main body 71 of each outer frame 7 associated therewith is accommodated relatively in a manner slidable in the connector arranging direction DC.

Each side wall 51 is formed with a plurality of guide slots 51*b* at equally-spaced intervals in the connector arranging direction DC. The guide slots 51*b* are each so formed as to extend from near an upper end to a lower end of the side wall 51 in the fitting/removing direction DF of the cable connector 15. The guide slots 51*b* are communicated with the recess 51*a*. The guide slots 51*b* guide the bosses 32*b* and 32*b'* of the mold bosses 32 and 32' in the fitting/removing direction DF. The bosses 32*b* and 32*b'* protrude into the accommodating recesses 51*a* via the guide slots 51*b*.

Each side wall 51 has an inner surface formed with a plurality of guide pieces 51*c* at equally-spaced intervals in the connector arranging direction DC. The guide pieces 51*c* are each so formed to extend from the upper end to the lower end of the side wall 51 in the fitting/removing direction DF of the cable connector 15. The guide pieces 51*c* are disposed at adjacent locations to the guide slots 51*b*, for guiding the operation members 3 and 3' in the fitting/removing direction DF.

Each side wall 51 has one end formed with a guide groove 51*d*. The guide groove 51*d* extends in the fitting/removing direction DF. A lower end of the guide groove 51*d* opens downward. The guide groove 51*d* receives an associated one of bosses 932 of a shutter (driving member) 93 of the drive force transfer unit 9 (see FIG. 1), and guides the associated boss 932 in the fitting/removing direction DF.

Further, each side wall 51 has an upper surface of one end formed with a hole 51*e*. A spring pin 55 is press-fitted in the hole 51*e*. A lower end of the spring pin 55 protrudes into the guide groove 51*d*.

Further, each side wall 51 has opposite ends formed with protrusions 51*f* on the upper surface, respectively. Each protrusion 51*f* has an outer surface formed with a cutout 51*g*.

The side walls 53 and 54 extend in the direction which is orthogonal to the fitting/removing direction DF and the connector arranging direction DC. The side walls 53 and 54 are parallel to each other. The side wall 53 is continuous with one ends of the side walls 51 and 51, and the side wall 54 is continuous with the other ends of the side walls 51 and 51.

The side wall 53 has an outer surface formed with a recess 53*a*. The recess 53*a* is formed with a concavely curved surface 53*b*.

As shown in FIG. 2, the pair of outer frames 7 guide the inner frame 5 such that the inner frame 5 moves between an initial position (position of the inner frame 5 (shown in FIG. 21) before the outer frames 7 guide the operation members 3 and 3' toward the header connectors 21) and a fitting-completed position (position of the inner frame 5 (shown in FIG. 26) after the outer frames 7 have caused all cable connectors 15 to be fitted to the header connector 21).

Each outer frame 7 is substantially prism-shaped, and is made of a synthetic resin. The outer frame 7 has a frame main body 71 and leg portions 72 and 73.

Figure 6A:
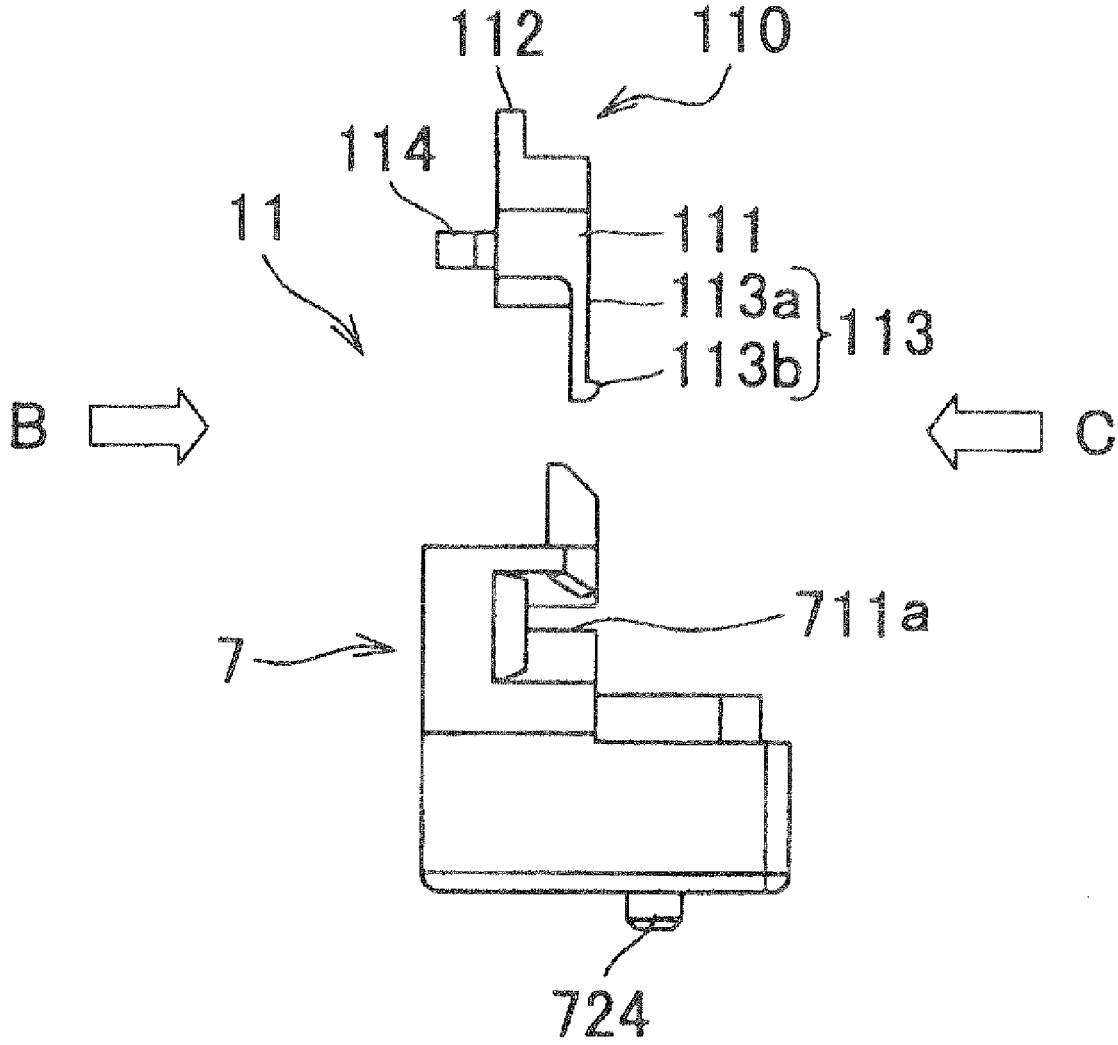
FIG. 6A is a front view of an opening/closing member of the object fitting/removing drive unit shown in FIG. 1 in a state in which the opening/closing member has not been mounted in the outer frame.
Figure 6B:
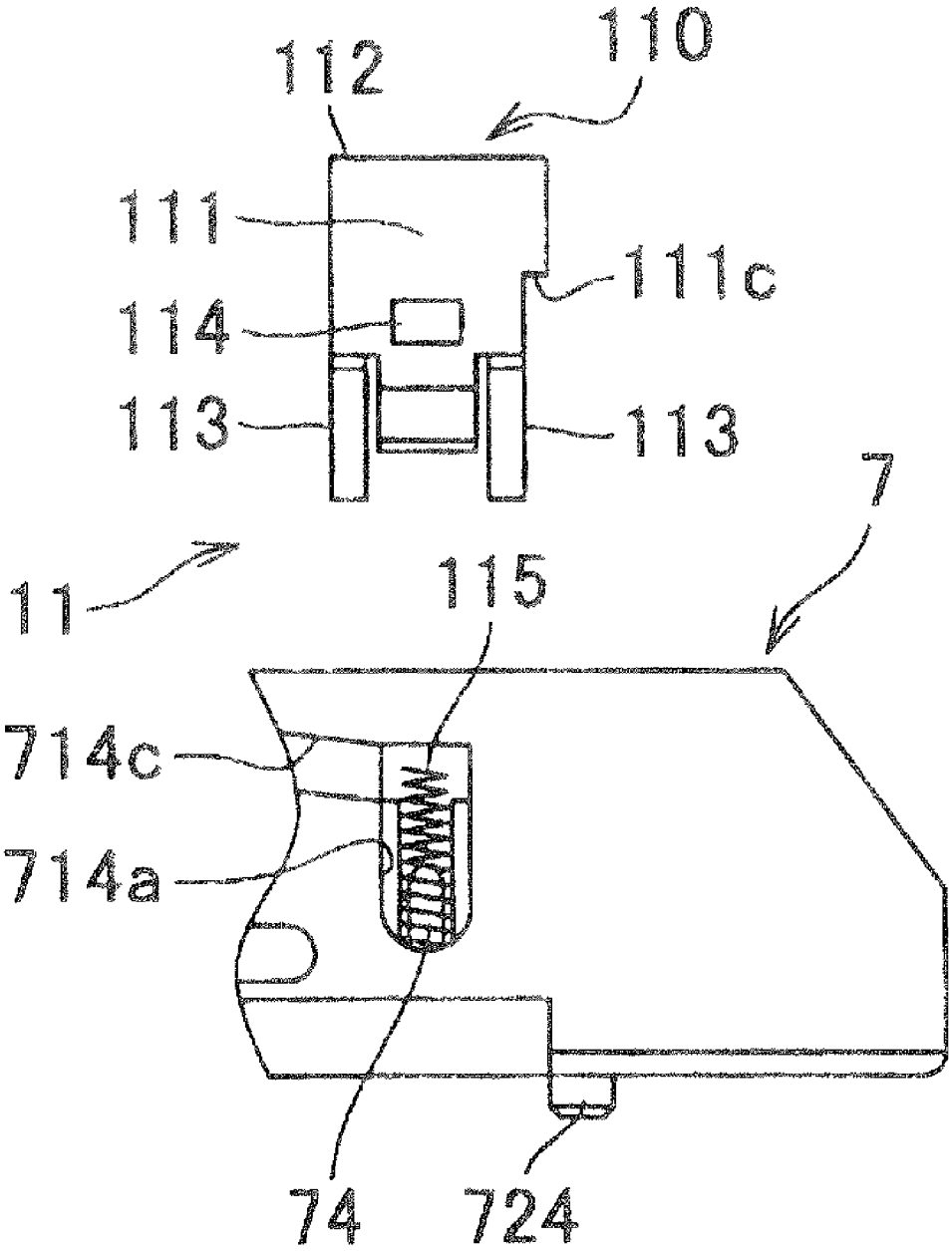
FIG. 6B is a view taken in the direction of an arrow B in FIG. 6A.
Figure 6C:
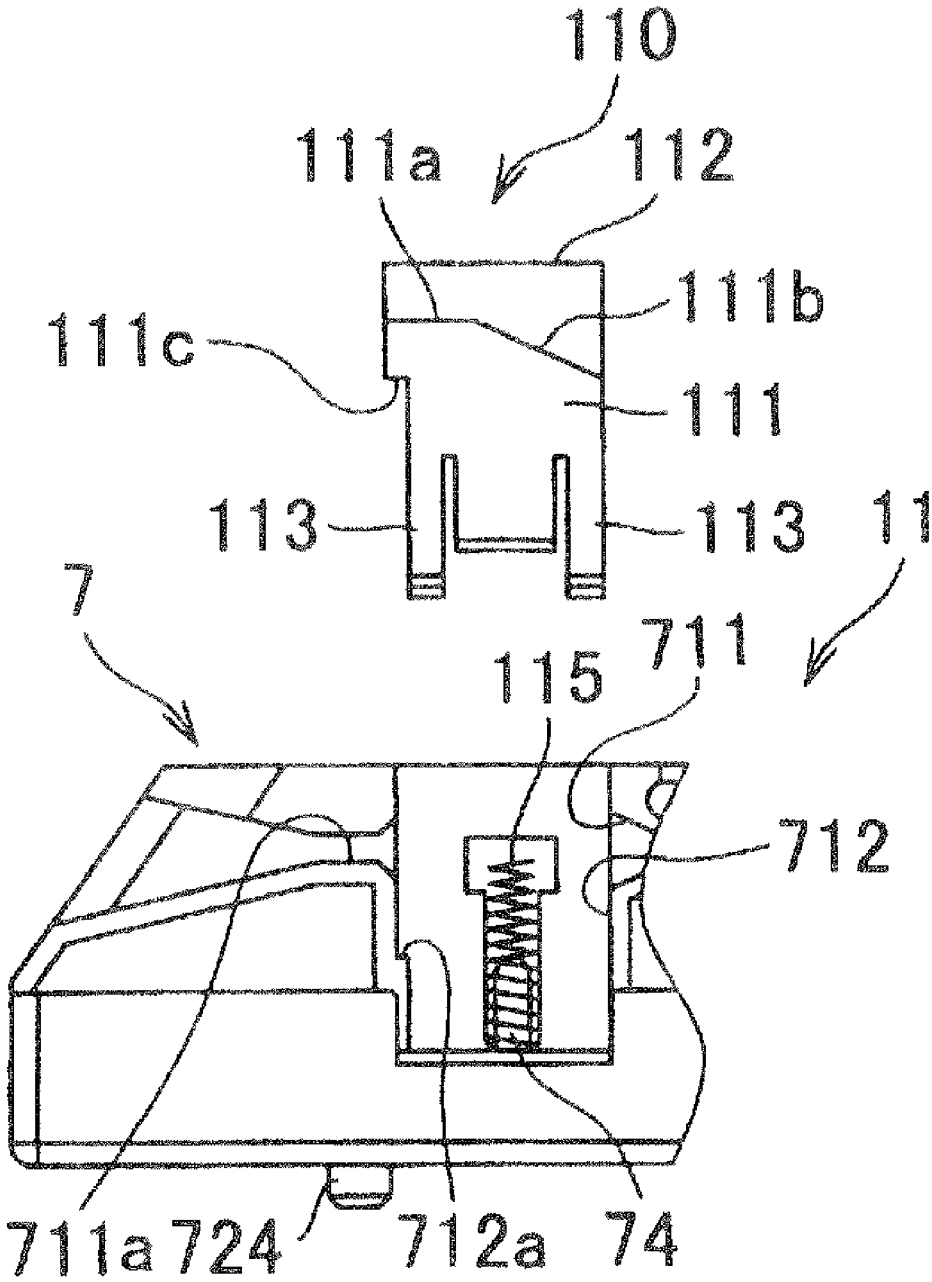
FIG. 6C is a view taken in the direction of an arrow C in FIG. 6A.

The frame main body 71 has an outer surface formed with a guide groove 711 and a guide-in portion 711*a* which guides an associated one of flanges 253 (see FIG. 9) of a coupling member 25 into the guide groove 711. The guide-in portion 711*a* guides the associated flange 253 of the coupling member 25 into an entrance of the guide groove 711, and the guide groove 711 guides the flange 253 (see FIG. 9) of the coupling member 25 in the connector arranging direction DC. Further, an accommodating recess 712 is formed in the outer surface of the frame main body 71. The accommodating recess 712 extends in the fitting/removing direction DF which is orthogonal to the guide groove 711. The accommodating recess 712 has an inner wall surface formed with a stepped surface 712*a* (see FIG. 6C). An opening/closing member 110 of an associated one of the abnormal fitting prevention devices 11 is accommodated in the accommodating recess 712 in a manner movable in the fitting/removing direction DF. A spring pin 74 is press-fitted in a hole, not shown, which is formed in a bottom of the accommodating recess 712. An upper part of the spring pin 74 protrudes into the accommodating recess 712. Further, holes 713 which are adjacent to the accommodating recess 712 are formed in the outer surface of the frame main body 71 (see FIG. 7B). Locking portions 113 of an associated one of the opening/closing members 110 are inserted in the holes 713, respectively.

Figure 5:
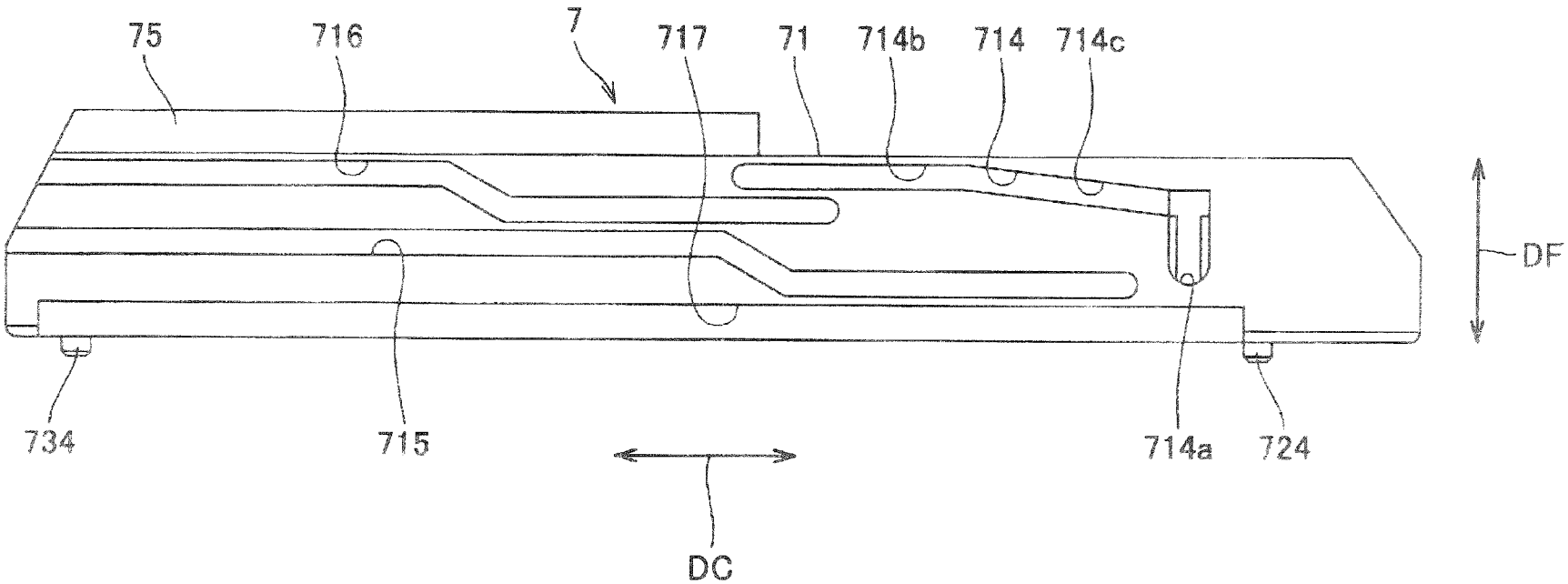
FIG. 5 is a schematic view of some of grooves formed in an inner surface of an outer frame of the object fitting/removing drive unit shown in FIG. 1.

As shown in FIG. 5, the frame main body 71 has an inner surface formed with a guide groove 714. The guide groove 714 includes a vertical portion 714*a*, a horizontal portion 714*b*, and an inclined portion 714*c*. The vertical portion 714*a* extends in the fitting/removing direction DF. The horizontal portion 714*b* extends in the connector arranging direction DC. The inclined portion 714*c* connects between the vertical portion 714*a* and the horizontal portion 714*b*. The boss 932 (see FIGS. 21 and 26) of the shutter 93 of the drive force transfer unit 9 is movably inserted in the guide groove 714. Further, a boss 114 of the opening/closing member 110 is movably inserted in the vertical portion 714*a* (see FIGS. 21 and 26). The vertical portion 714*a* guides the boss 114 in the fitting/removing direction DF.

Further, the frame main body 71 has an inner surface formed with a first cam groove 715 and a second cam groove 716. The first cam groove 715 extends in the connector arranging direction DC, and is bent into a substantial crank shape. The bosses 32*b* of the first operation members 3 are slidably inserted in the first cam groove 715 (see FIGS. 21 and 26). The second cam groove 16 extends in the connector arranging direction DC, and is bent into a substantial crank shape. The second cam groove 716 is upward of the first cam groove 715. The bosses 32*b*' of the second operation member 3' are slidably inserted in the second cam grooves 74 (see FIGS. 21 and 26).

Further, an accommodating recess 717 is formed in a bottom side of the inner surface of the frame main body 71. A bottom part of an associated one of the side walls 51 of the inner frame 5 is accommodated in the accommodating recess 717 in a manner movable in the connector arranging direction DC.

Further, a guide piece 75 is joined to the upper surface of the frame main body 71.

As shown in FIG. 2, the leg portion 72 is continuous with an outer side of one end of the frame main body 71. A recess 721 is formed in a central portion of the leg portion 72. A flat surface 722 is formed on the upper surface of the leg portion 72 at a location toward one end thereof. A protrusion 723 is formed on the upper surface of the leg portion 72 at a location toward the other end thereof. The protrusion 723 is formed with a hole 723*a*. The leg portion 72 has a lower surface formed with a positioning boss 724 (see FIGS. 6A, 6B and 6C).

As shown in FIG. 2, the leg portion 73 is continuous with an outer side of the other end of the frame main body 71. A recess 731 is formed in a central portion of the leg portion 73. A protrusion 733 is formed on the upper surface of the leg portion 73 at a location toward one end thereof. The protrusion 733 is formed with a hole 733*a*. The leg portion 73 has a lower surface formed with a positioning boss 734 (see FIG. 5).

As shown in FIG. 2, the drive force transfer unit 9 includes a link 91 and the shutter 93. The shutter 93 also serves as a driving member of the abnormal fitting prevention device 11, described hereinafter.

The link 91 has a substantially Y-shaped cross-section. The link 91 includes a base portion 911, a first projecting piece 912, and a second projecting piece 913.

The base portion 911 is substantially plate-shaped. A lower end surface of the base portion 911 is convexly curved, and is rotatably supported by the curved surface 53*b* of the recess 53*a* of the side wall 53. This makes the link 91 pivotally movable about the center of the lower end of the base portion 911.

The first projecting piece 912 is substantially plate-shaped, and is continuous with the upper part of the base portion 911. The second projecting piece 913 is substantially plate-shaped, and is opposed to the first projecting piece 912.

The second projecting piece 913 has opposite side surfaces formed with holes 913*a*. One end of a spring pin 92 is press-fitted in an associated one of the holes 913*a*, and the other end of the spring pin 92 protrudes from the second projecting piece 913.

The first projecting piece 912 is longer than the second projecting piece 913, and the position of an end of the first projecting piece 912 is higher than that of an end of the second projecting piece 913. An accommodating space 914 (see FIG. 27) is formed between the first projecting piece 912 and the second projecting piece 913.

The base portion 911 and the first projecting piece 912 of the link 91 are accommodated in the recess 53*a* of the side wall 53.

As shown in FIG. 2, the shutter 93 includes a pair of sliding portions 931, a pair of the bosses 932, a pair of projecting pieces 933, and a connecting portion 934, and is made of a synthetic resin.

Each sliding portion 931 is substantially plate-shaped, and is movably inserted in an associated one of the guide grooves 51*d* of the side wall 51. Each sliding portion 931 has an upper surface formed with a hole 931*a*. A lower end of a spring 94 is inserted in the hole 931*a*. The spring 94 is accommodated in the guide groove 51*d*, and the upper end thereof is fitted on the lower end of the spring pin 55 which protrudes into the guide groove 51*d*. Each sliding portion 931 is pressed downward by the spring 94.

Each boss 932 is substantially cylindrically shaped, and is continuous with one side surface of the sliding portion 931. The boss 932 protrudes from the guide groove 51*d*, and is movably inserted in the associated vertical portion 714*a* of the guide groove 714 of the outer frame 7.

Each projecting piece 933 is substantially plate-shaped, and is continuous with the other side surface of the sliding portion 931.

Each sliding portion 931 and each projecting piece 933 are formed with a guide hole 935. The guide hole 935 extends in the connector arranging direction DC. An associated one of the spring pins 92 is movably inserted in the guide hole 935.

The connecting portion 934 is substantially plate-shaped, and connects the sliding portions 931.

As shown in FIG. 2, each abnormal fitting prevention device 11 is formed by the opening/closing member 110, a spring 115, and the shutter 93.

The opening/closing member 110 is made of a synthetic resin, and includes a main body 111, a guide piece 112, the locking portion 113*s*, and the boss 114. The main body 111 has an upper surface 111*a* formed with an inclined surface 111*b* (see FIG. 6C). The main body 111 is formed with a stepped surface 111*c*.

The guide piece 112 is continuous with an upper part of the main body 111.

The locking portions 113 are continuous with a lower part of the main body 111. Each locking portion 113 includes an arm portion 113*a* and a lug 113*b*.

The boss 114 is continuous with the main body 111. The boss 114 is inserted in the vertical portion 714*a* of the guide groove 714.

The main body 111 is accommodated in the accommodating recess 712 of each outer frame 7 in a manner movable in the fitting/removing direction DF. If the main body 111 reciprocates along the fitting/removing direction DF, the upper part of the main body 111 closes and opens the entrance of the guide groove 711. When the boss 932 of the shutter 93 is in its lowest position in the vertical portion 714*a* of the guide groove 714, the upper surface 111*a* of the main body 111 is in a position lower than the guide groove 711 of the outer frame 7. Each locking portion 113 is inserted in the associated hole 713 of the outer frame 7. The lug 113*b* of the locking portion 113 is engaged with a lower surface of a bottom board 725 (see FIG. 7B) which forms the recess 721 of the leg portion 72. This restricts the upward motion of the opening/closing member 110. When the lug 113*b* of the locking portion 113 is engaged with the lower surface of the bottom board 725 of the leg portion 72, the upper part of the main body 111 protrudes into the guide groove 711 to close the entrance of the guide groove 711. When the boss 932 of the shutter 93 is moved into the vertical portion 714*a* of the guide groove 714, the boss 114 is in a position below the boss 932.

The spring 115 is located between the bottom surface of the accommodating recess 712 and the lower surface of the main body 111 of the opening/closing member 110. A lower end of the spring 115 is fitted on the pin 74, and an upper end of the spring 115 is brought into contact with the lower surface of the main body 111 of the opening/closing member 110. When the boss 114 of the opening/closing member 110 is not in the position below than the boss 932 of the shutter 93, the opening/closing member 110 is pushed upward by the spring 115 to close the entrance of the guide groove 711.

The base plate 13 is formed by blanking and bending a metal plate. As shown in FIG. 2, the base plate 13 includes a plate main body 131, a pair of side walls 132, and a pair of side walls 133.

The plate main body 131 is flat plate-shaped, and is formed with a rectangular window hole 131*a*. Further, the plate main body 131 has four corners formed with positioning holes 131*b*.

The side walls 132 are continuous with edges of the plate main body 131 which are parallel to the connector arranging direction DC. Each side wall 132 is formed with a projecting piece 132*a*. The projecting piece 132*a* extends in the connector arranging direction DC. The side walls 133 are continuous with edges of the plate main body 131 which are parallel to a direction which is orthogonal to the connector arranging direction DC and the fitting/removing direction DF.

As shown in FIGS. 8A and 8B, the header connectors 21 which are the objects to be connected to the cable connectors 15 (see FIG. 20) are mounted on the substrate 23 to which a stiffener 24 is glued for reinforcement. Further the coupling member 25 is fixed to the substrate 23 via the stiffener 24.

Figure 9:
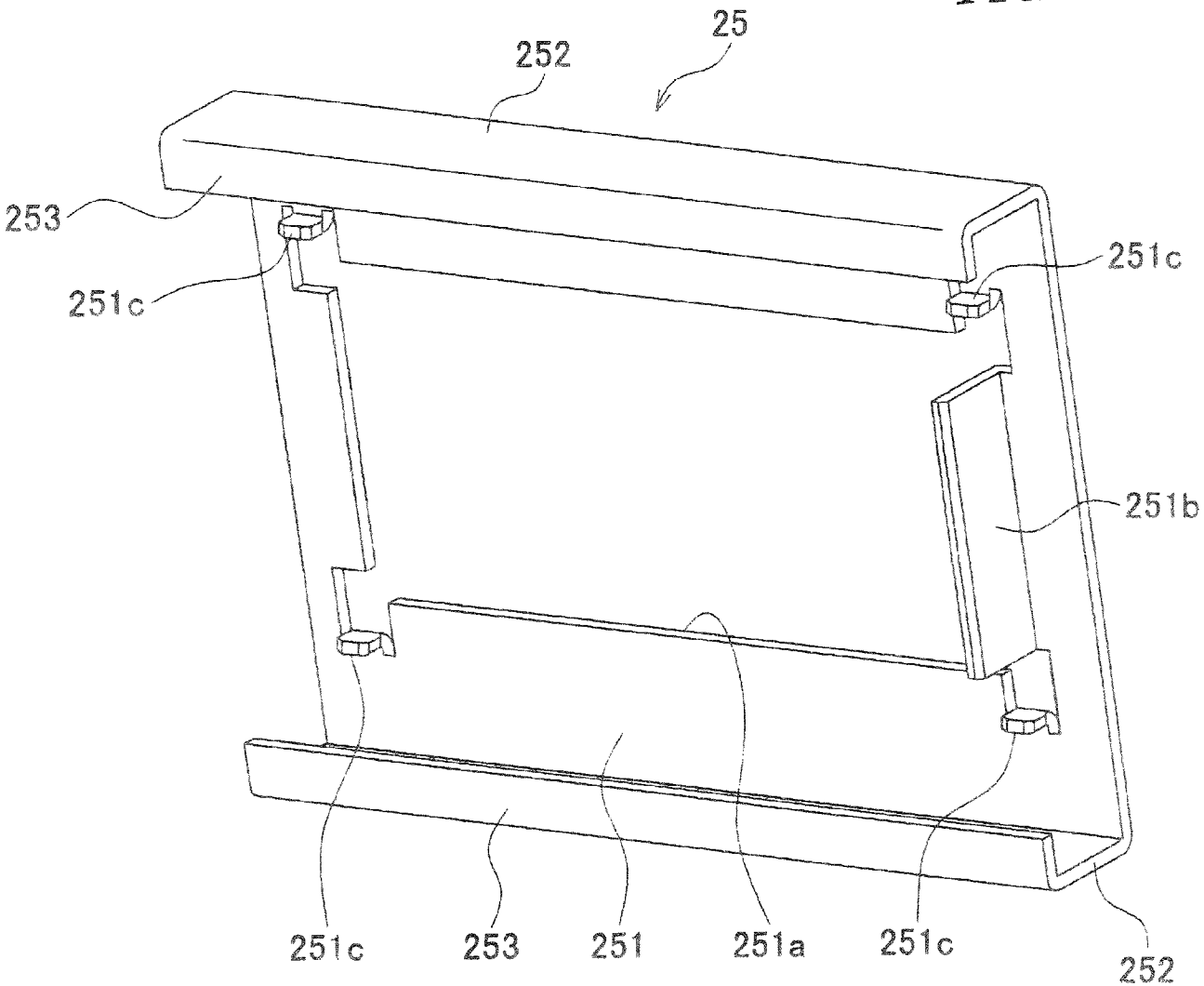
FIG. 9 is a perspective view of the coupling member for being mounted on the substrate.

As shown in FIG. 9, the coupling member 25 is formed by blanking and bending a metal plate, and includes a main body 251, a pair of side wall portions 252, and a pair of flanges 253. The coupling member 25 is fixed to the substrate 23 in a manner surrounding the header connectors 21. The main body 251 is formed with a rectangular window hole 251*a*. The window hole 251*a* admits the header connectors 21. The main body 251 is formed with a pressing piece 251*b* along one side of the window hole 251*a*. The main body 251 is formed with bent pieces 251*c* which are adjacent to four corners of the window hole 251*a*. The bent pieces 251*c* are inserted in the cutouts 51*g* in the protrusions 51*f* of the inner frame 5 (see FIG. 2). This positions the coupling member 25 with respect to the inner frame 5.

Next, a description will be given of a procedure for assembling the object fitting/removing drive unit 1 shown in FIG. 2.

First, the spring pins 55 are press-fitted in the holes 51*e*, the spring pins 74 are press-fitted in the holes of the bottoms of the accommodating recesses 712, and the spring pins 92 are press-fitted in the holes 913*a*, respectively.

Next, the upper parts of the springs 94 are fitted on the spring pins 55, and the springs 94 are received in the guide grooves 51*d*. Similarly, the lower parts of the springs 115 are fitted on the spring pins 74, and the springs 115 are accommodated in the accommodating recesses 712.

Then, the bosses 32*b* and 32*b*' (see FIGS. 3A, and 4A) of the first and second operation members 3 and 3' are extended through the guide long holes 51*b* from the lower ends of the guide long holes 51*b* of the inner frame 5, respectively.

Next, the link 91 is accommodated in the recess 53*a* of the side wall 53 of the inner frame 5, the sliding portions 931 of the shutter 93 are inserted in the guide grooves 51*d* of the side walls 51, and the spring pins 92 of the link 91 are inserted in the guide holes 935 of the shutter 93.

Then, the inner frame 5 on which the first and second operation members 3 and 3', the link 91, and the shutter 93 are mounted is disposed on the plate main body 131 of the base plate 13.

Figure 7A:
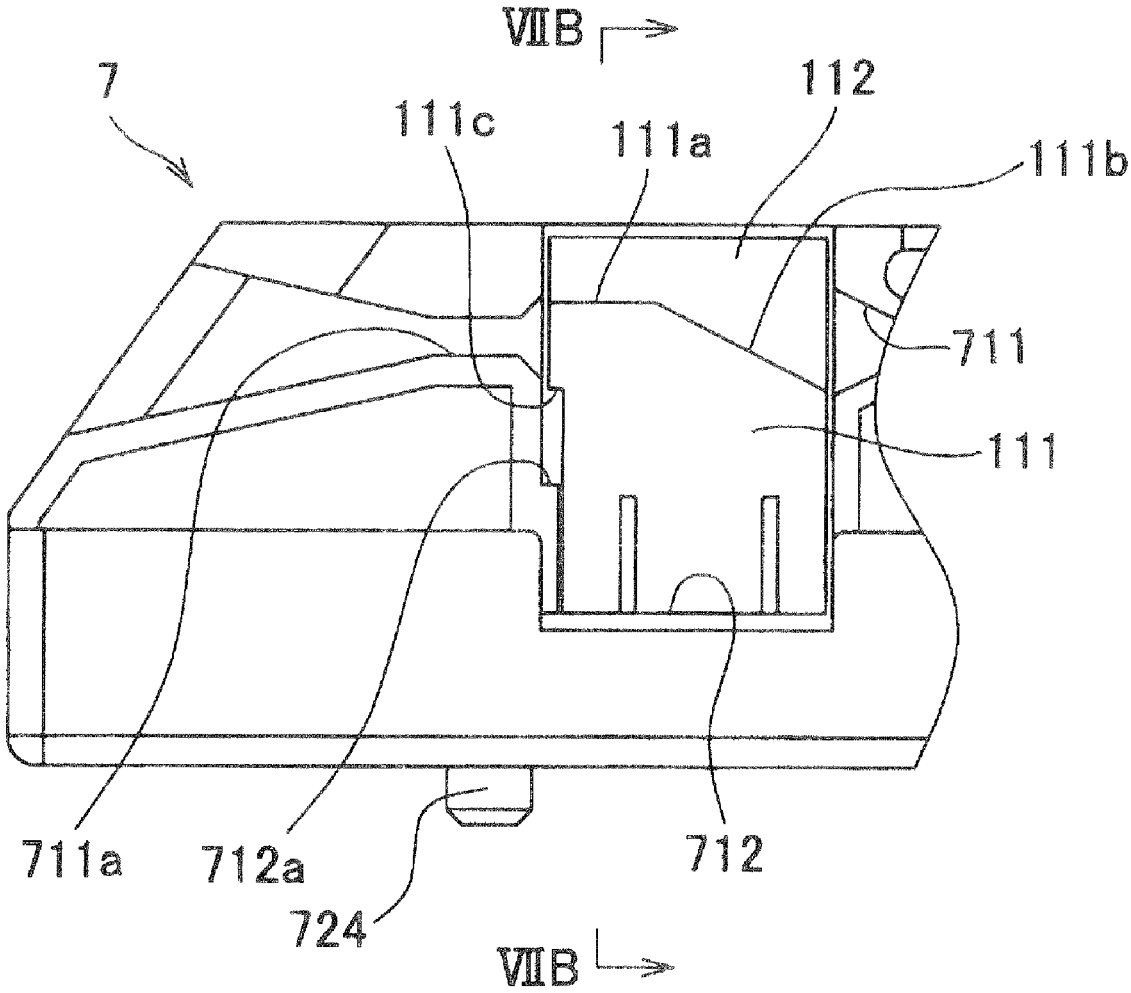
FIG. 7A is a side view of the opening/closing member shown in FIG. 6C and the outer frame in a state in which the opening/closing member has been mounted in the outer frame.
Figure 7B:
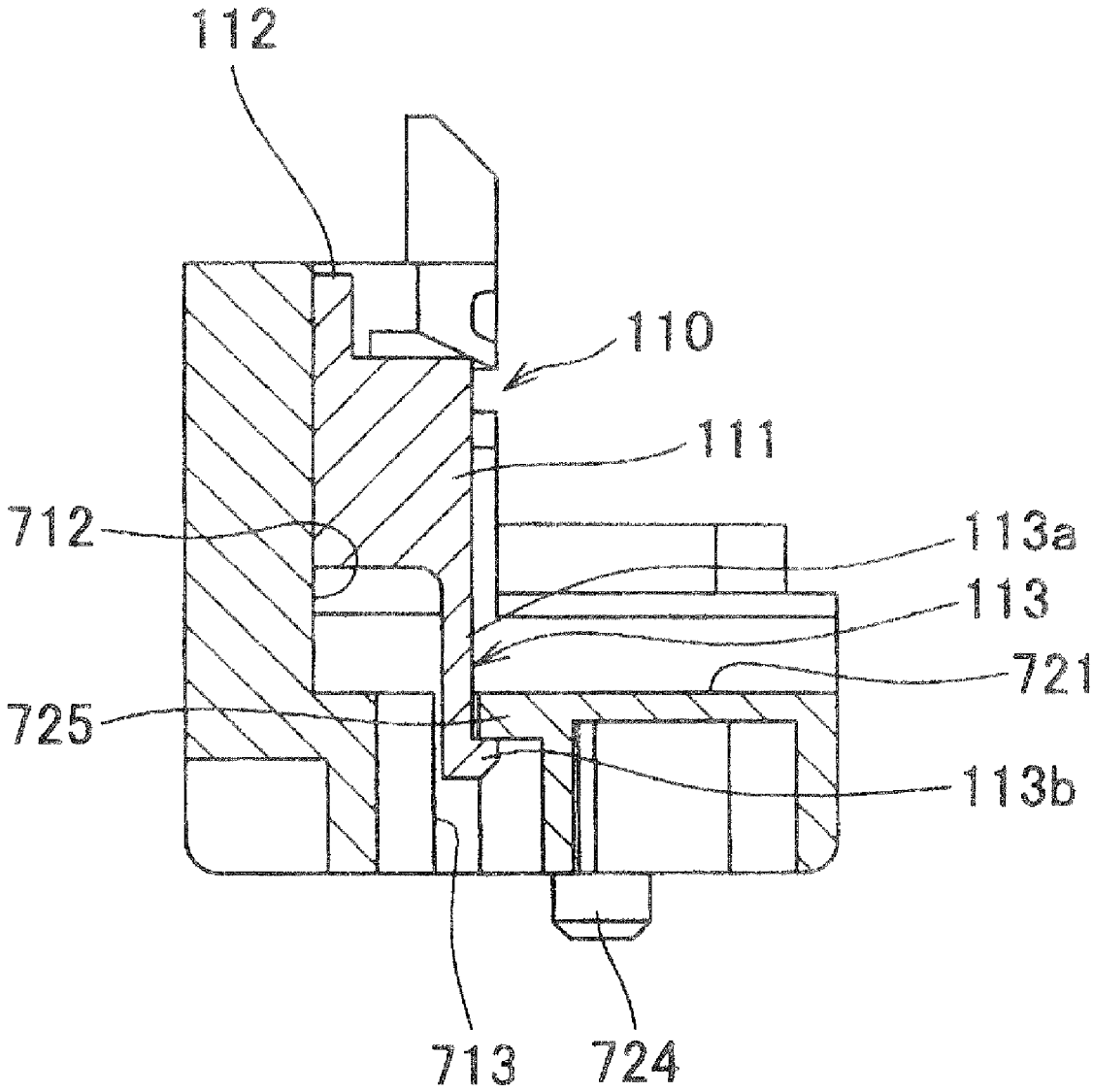
FIG. 7B is a cross-sectional view taken on line VIIB-VIIB in FIG. 7A.

Next, the opening/closing members 110 are accommodated in the accommodating recesses 712 of the outer frames 7, and as shown in FIG. 7B, the locking portions 113 of the opening/closing members 110 are inserted in the holes 713 of the outer frames 7. Then, the lugs 113*b* of the locking portions 113 are hooked on the bottom boards 725 of the outer frames 7. As a result, the opening/closing members 110 are pressed upward by the springs 115 so as to close the entrances of the guide grooves 711.

Then, the outer frames 7 are disposed on the plate main body 131, and are fixed to the base frame 13 by bolts and nuts, not shown. At this time, the bosses 32*b* of the first operation members 3 are inserted in the first cam grooves 715, and the bosses 32*b*' of the second operation members 3' are inserted in the second cam grooves 716. Further, the bosses 932 of the shutter 93 are inserted in the guide grooves 714. Further, the positioning bosses 724 and 734 (see FIG. 5) of the outer frame 7 are inserted in the positioning holes 131*b* of the base frame 13. As a result, the outer frames 7 are accurately positioned with respect to the base frame 13.

When the outer frames 7 are fixed to the base frame 13, the frame main bodies 71 of the outer frames 7 are relatively accommodated in the accommodating recesses 51*a* of the inner frame 5 in a manner movable in the connector arranging direction DC, and at the same time, the bottom parts of the side walls 51 of the inner frame 5 are accommodated in the accommodating recesses 717 of the outer frames 7 in a manner movable in the connector arranging direction DC. The bottom parts of the side walls 51 are trapped in the accommodating recesses 717, which makes the inner frame 5 unremovable from the outer frames 7.

Figure 10:
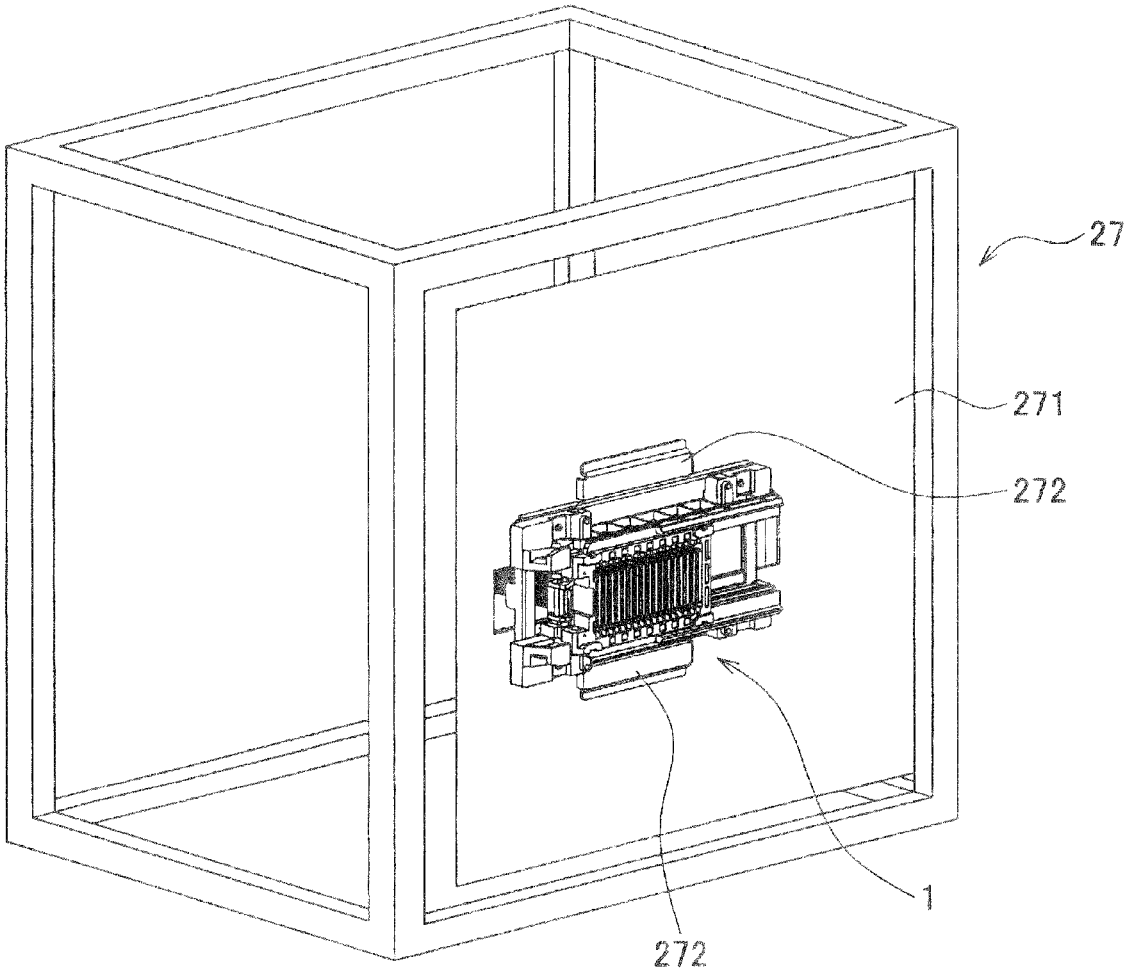
FIG. 10 is a schematic view of the object first casing fitting/removing drive unit shown in FIG. 1 and a in a state in which the former is mounted on the latter.
Figure 11:
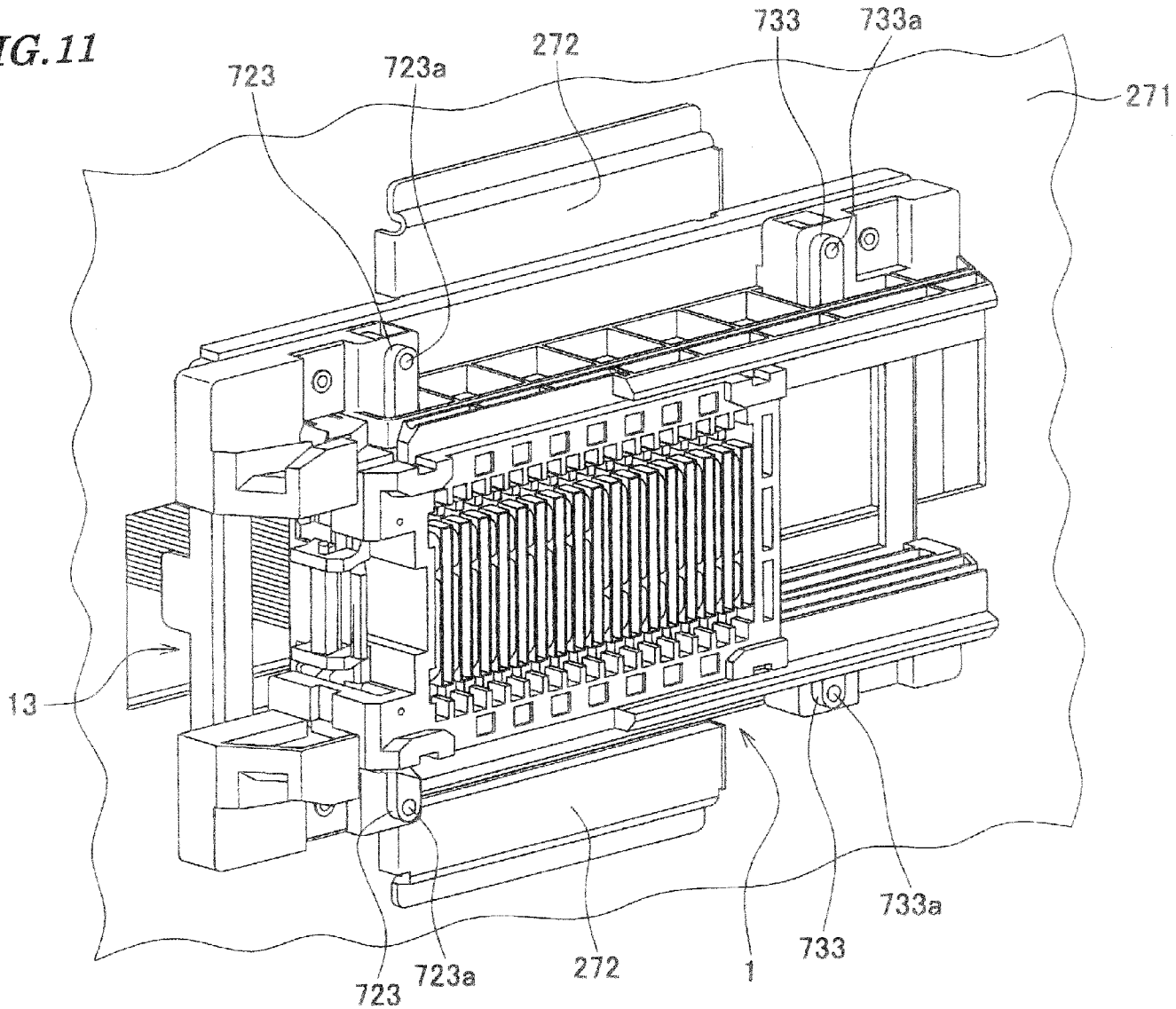
FIG. 11 is an enlarged partial perspective view of the object fitting/removing drive unit shown in FIG. 10.
Figure 12:
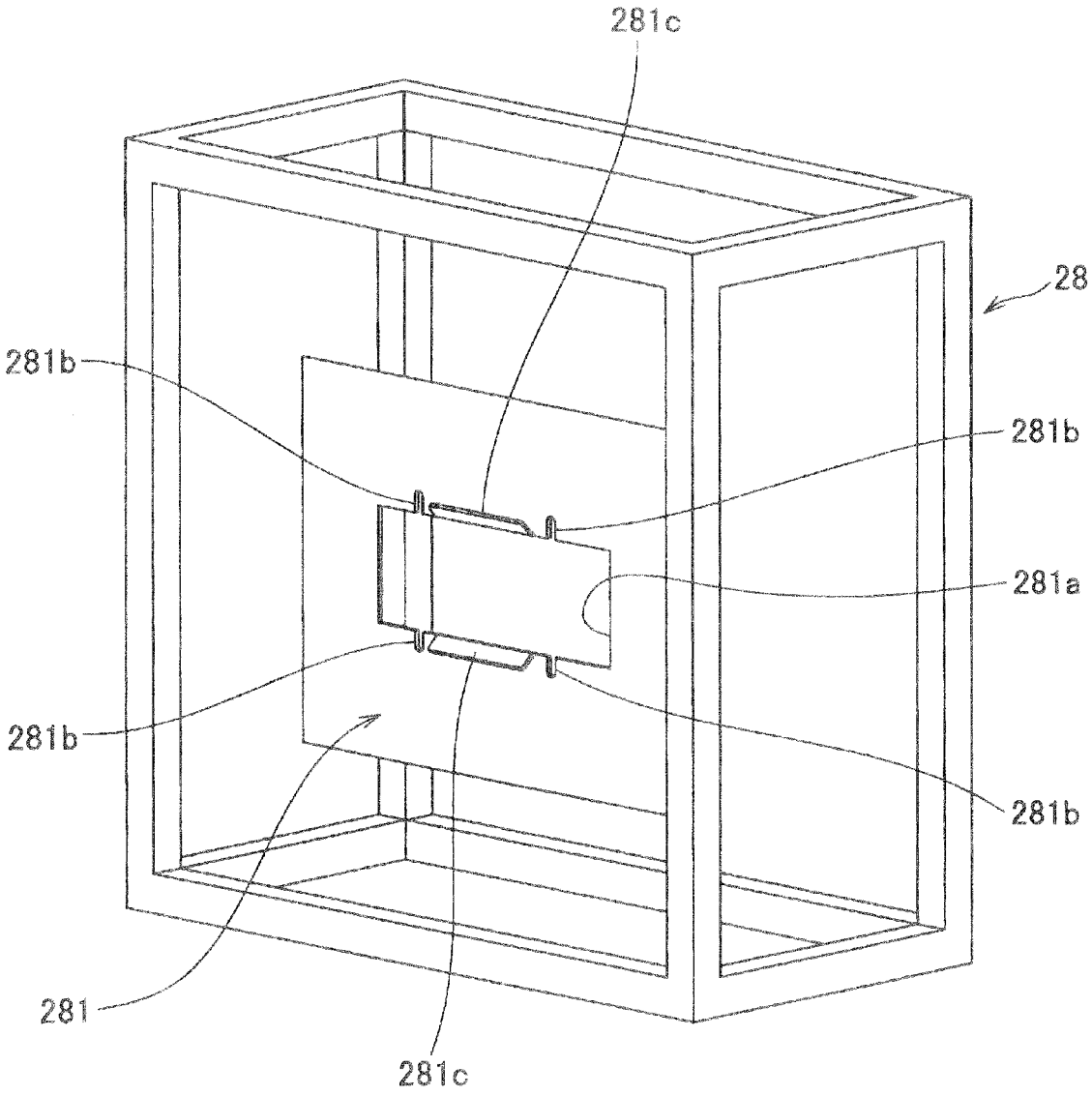
FIG. 12 is a schematic view of a second casing for being connected to the first casing shown in FIG. 10.
Figure 13:
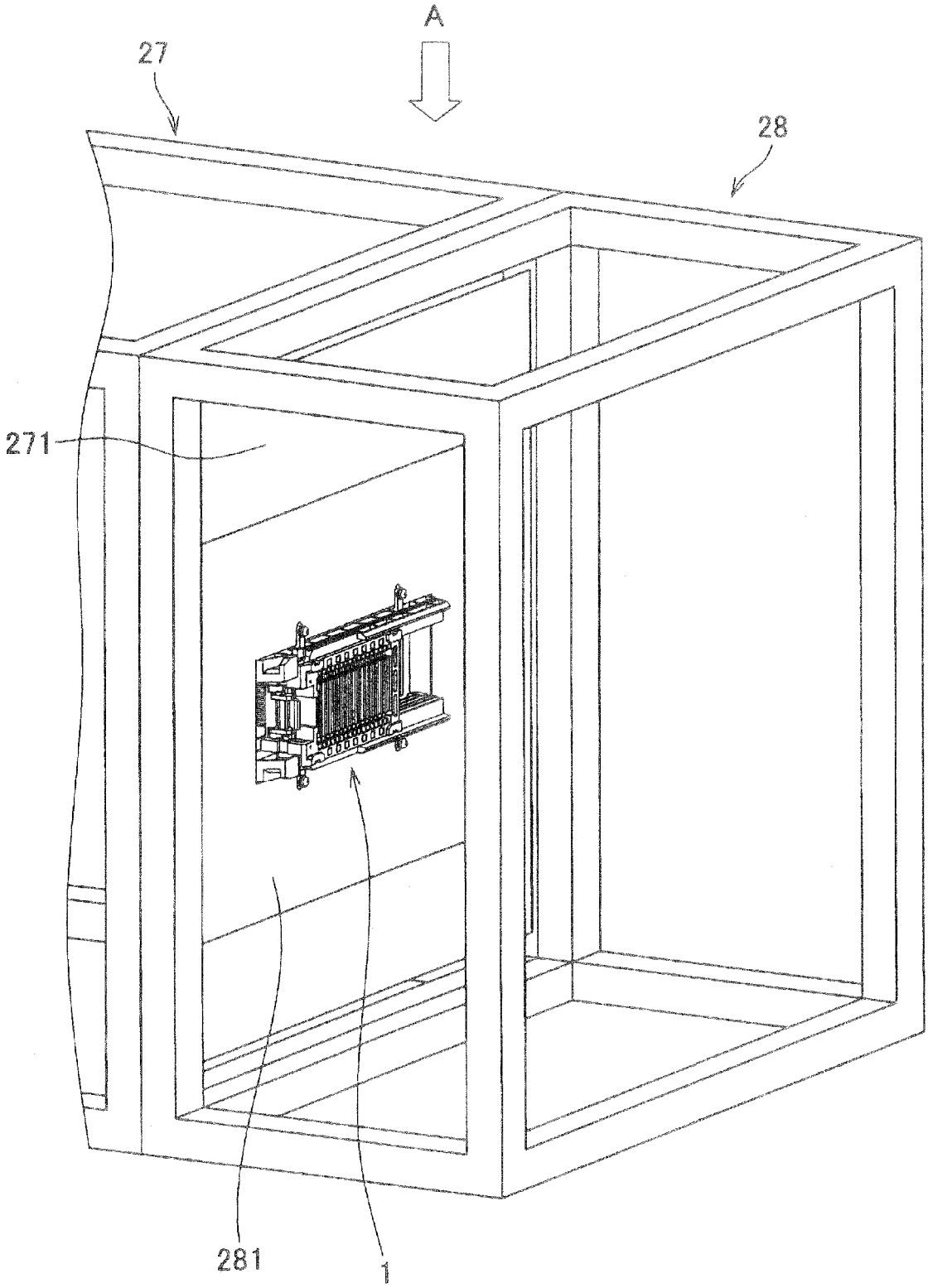
FIG. 13 is a schematic view of the first casing shown in FIG. 10 and the second casing shown in FIG. 12 in a state in which they are connected to each other.
Figure 14:
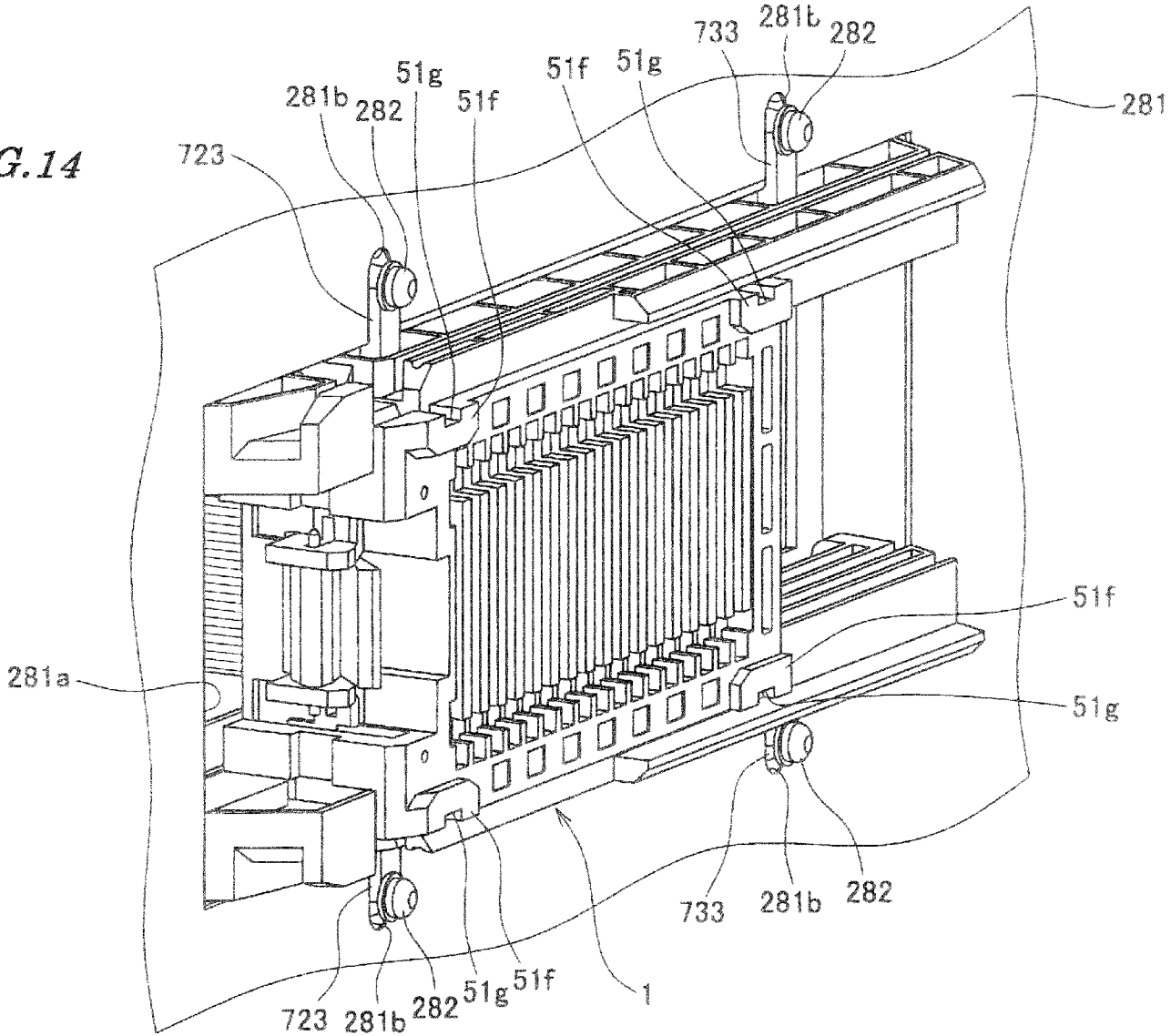
FIG. 14 is an enlarged partial perspective view of the object fitting/removing drive unit shown in FIG. 13.

As shown in FIGS. 10 and 11, the object fitting/removing drive unit 1 is mounted on an outer surface of a panel 271 of a first casing 27 of a super computer or the like. The pair of the projecting pieces 132*a* (see FIG. 2) are held by fixing members 272 which are mounted on the panel 271, whereby the object fitting/removing drive unit 1 is supported by the panel 271. A space formed between each fixing member 272 and the panel 271 is larger than each projecting pieces 132*a*, and hence the object fitting/removing drive unit 1 is held in a floating state in which it is slightly movable in vertical and horizontal directions as viewed in FIG. 10 and in the fitting/removing direction DF.

As shown in FIGS. 12, 13, 14, and 15, the object fitting/removing drive unit 1 which is mounted on the outer surface of the panel 271 of the first casing 27 is inserted in a second casing 28 via a window hole 281*a* of a panel 281 of the second casing 28, and is fixed to the panel 281 of the second casing 28.

The panel 281 of the second casing 28 includes the window hole 281*a*, four cutouts 281*b*, and a pair of guide projecting pieces 281*c*. The window hole 281*a* admits the object fitting/removing drive unit 1 into the inside of the second casing 28. The protrusions 723 and 733 of the outer frames 7 of the object fitting/removing drive unit 1 are inserted in the cutouts 281*b*. The guide projecting pieces 281*c* are continuous with respective portions of the panel 281 close to upper and lower edges of the window hole 281*a*. When inserting the object fitting/removing drive unit 1 into the window hole 281*a*, the guide projecting pieces 281*c* guide the object fitting/removing drive unit 1 into the second casing 28.

To fix the object fitting/removing drive unit 1 to the panel 281, first, the object fitting/removing drive unit 1 is inserted through the window hole 281*a*, and the protrusions 723 and 733 are inserted in the cutouts 281*b*.

Next, sems (screws with captive washer) 282 are screwed into screw holes (not shown) of the protrusions 723 and 733 inserted through the cutouts 281*b*. The dimension of the height of the protrusions 723 and 733 is larger than the dimension of the thickness of the panel 281, and further, the dimension of the outer diameter of a head part of the sems 282 is larger than the dimension of the width of the cutout 281*b*, so that the object fitting/removing drive unit 1 is fixed to the panel 281 in a floating state.

Figure 15:
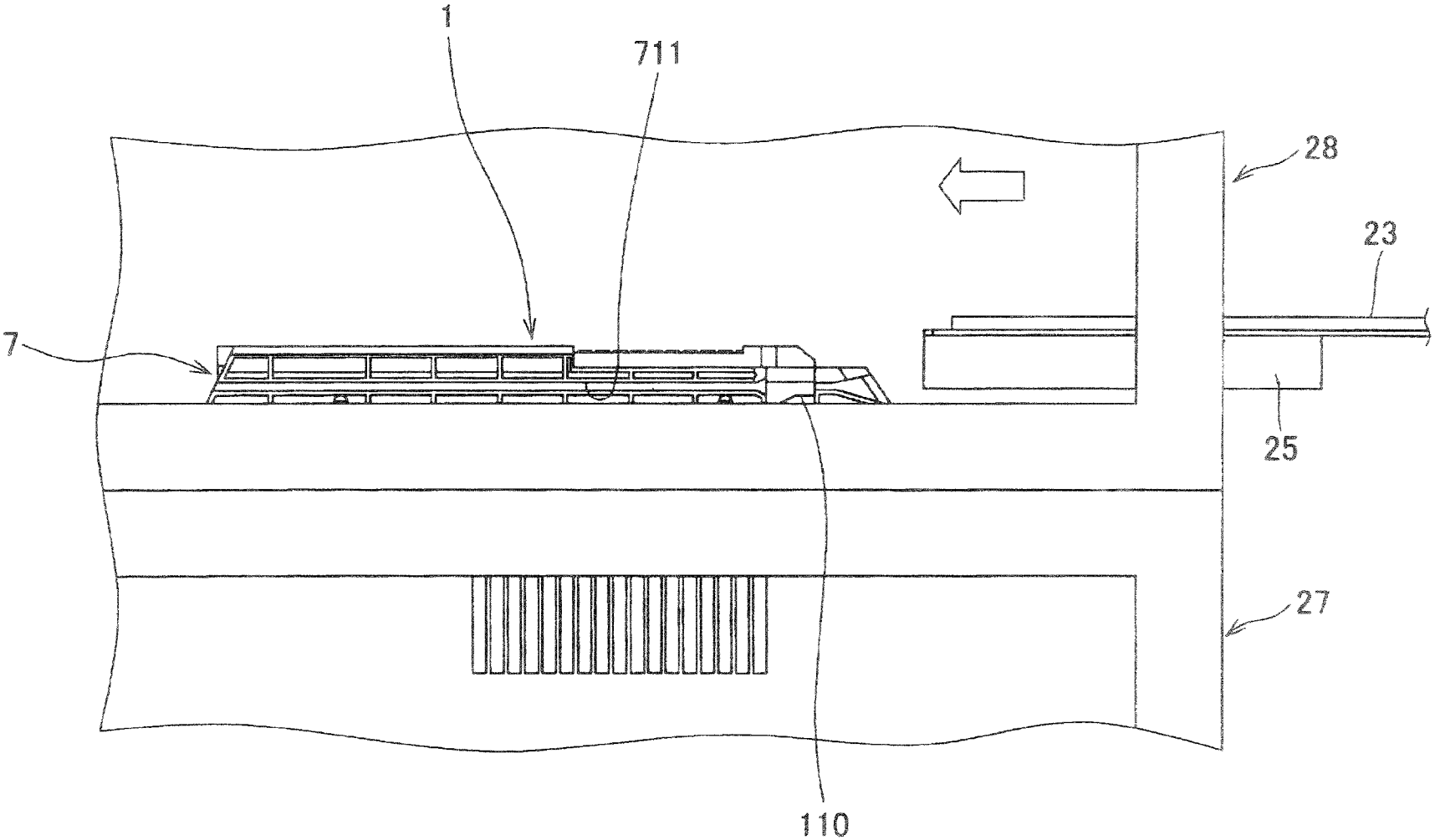
FIG. 15 is a view taken in the direction of the arrow A in FIG. 13 when the inner frame is in the initial position.
Figure 16:
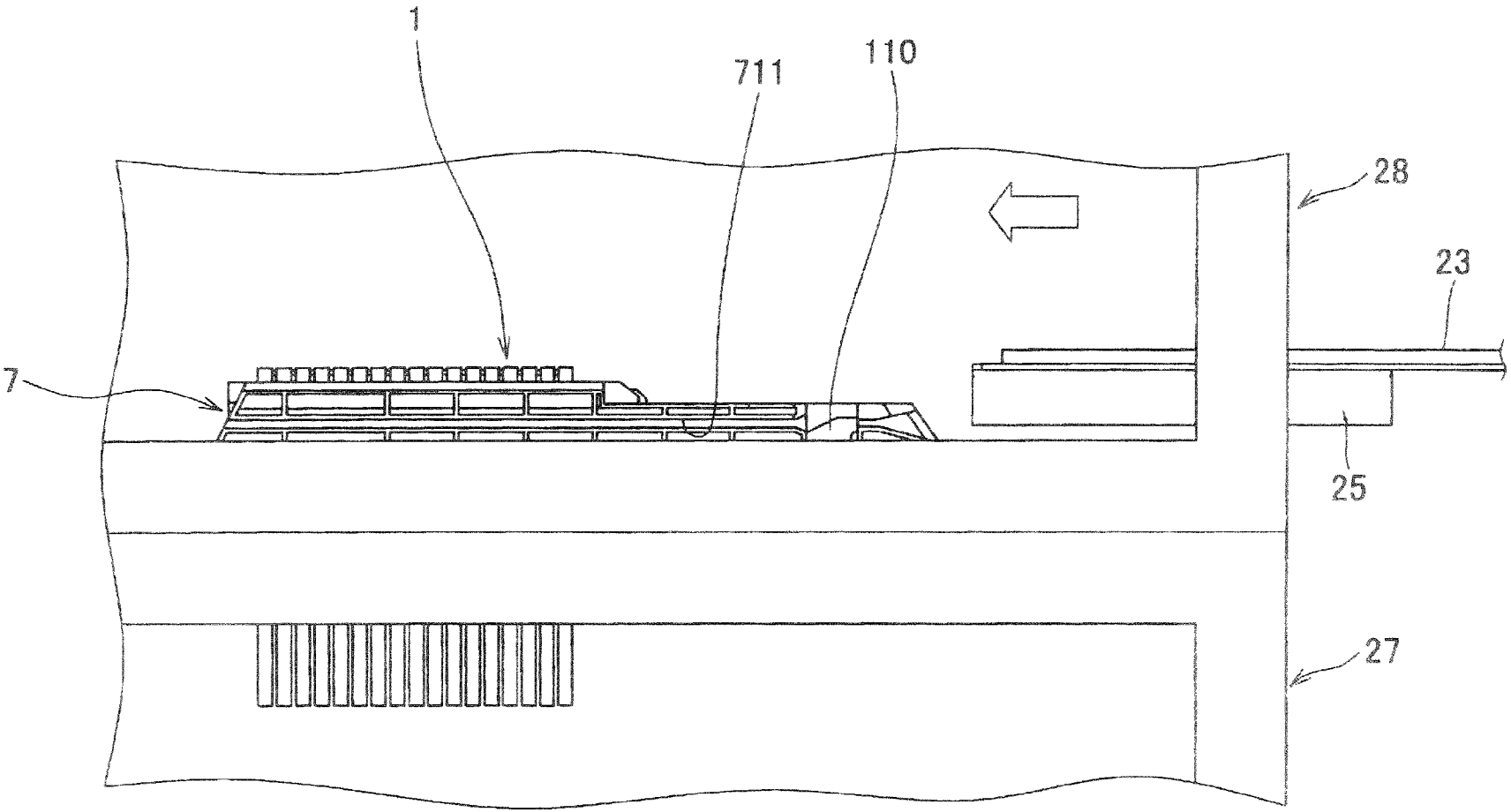
FIG. 16 is a view taken in the direction of the arrow A in FIG. 13 in a state in which the substrate etc. are inserted in the second casing shown in FIG. 13 when the inner frame is not in the initial position.
Figure 17A:
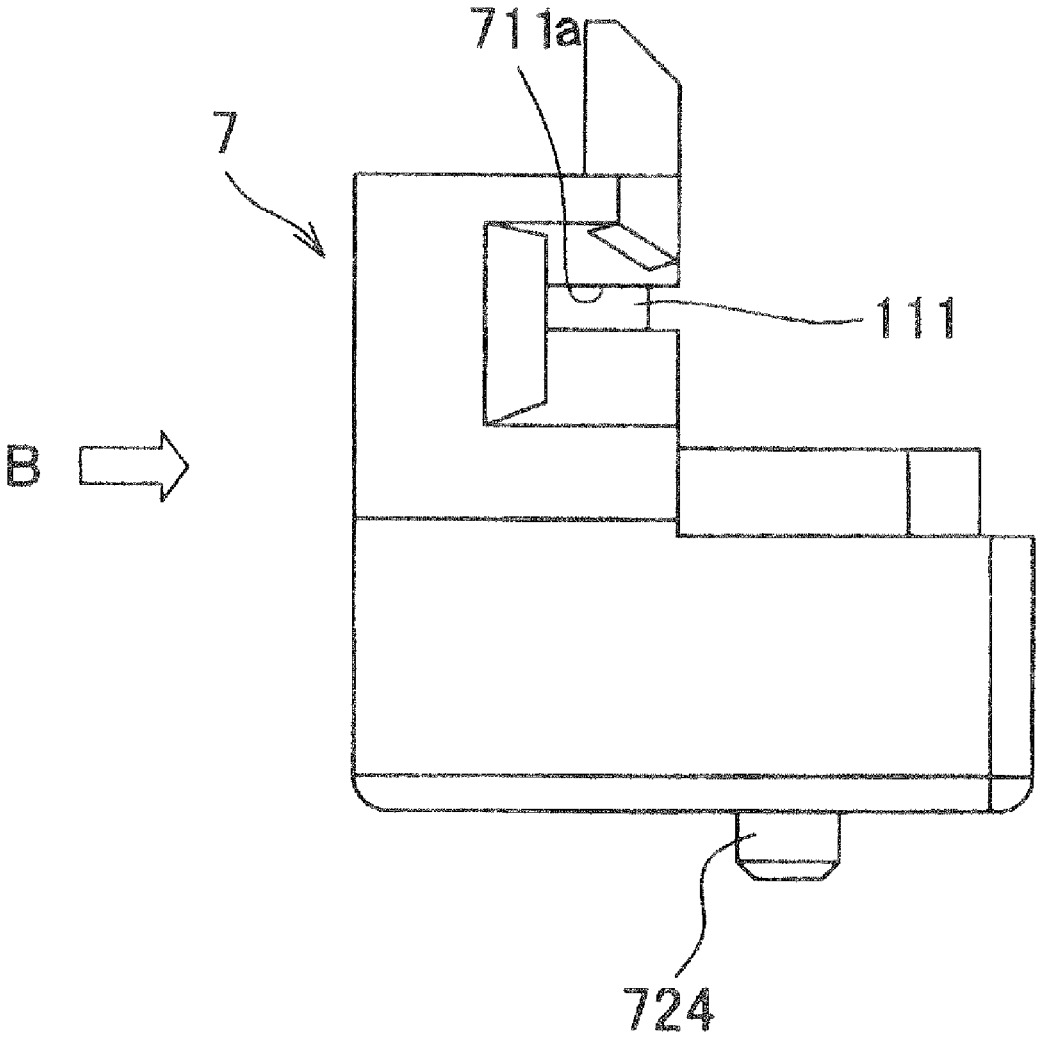
FIG. 17A is a front view of the opening/closing member in a state when the inner frame is not in the initial position.
Figure 17B:
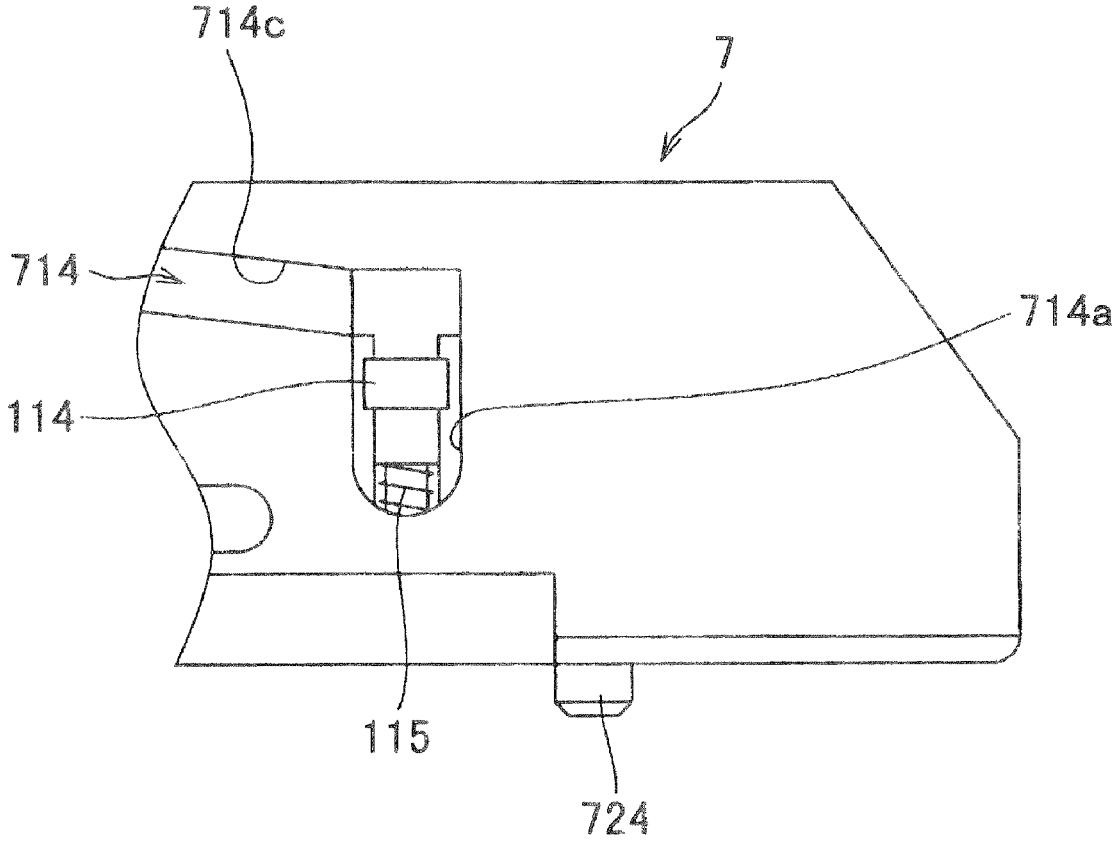
FIG. 17B is a view taken in the direction of the arrow B in FIG. 17A.

As shown in FIG. 15, the substrate 23 on which the coupling member 25 etc. is mounted is inserted into the object fitting/removing drive unit 1 from a direction (direction of an arrow in FIG. 15) which is orthogonal to the fitting/removing direction DF.

Next, a description will be given of the operation of the abnormal fitting prevention device 11 of the object fitting/removing drive unit 1. As shown in FIGS. 16, 17A, 17B, 7A, and 7B, when the inner frame 5 is not in the initial position (for example, when the coupling member 25 which is fixed to the substrate 23 has already been mounted on the inner frame 5 of the object fitting/removing drive unit 1), the bosses 932 of the shutter 93 are out of the associated vertical portion 714*a* of the guide groove 714, and are not engaged with the associated bosses 114 of the opening/closing member 110, so that the opening/closing member 110 is lifted up by the spring force of the spring 115, whereby the entrance of the guide groove 711 is closed by the main body 111 of the opening/closing member 110.

By closing the entrance of the guide groove 711 with the opening/closing member 110, each flange 253 of the coupling member 25 cannot be inserted into the guide groove 711, which prevents the cable connectors 15 and the header connectors 21 from being abnormally fitted to each other.

Figure 18A:
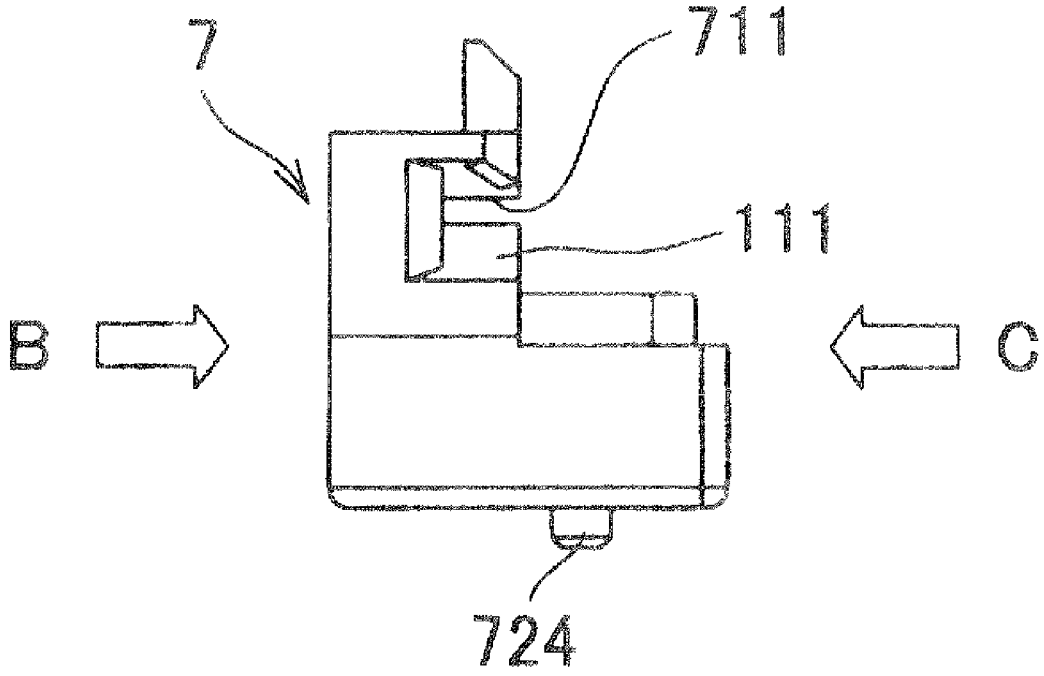
FIG. 18A is a front view of the opening/closing member in a state when the inner frame is in the initial position.
Figure 18B:
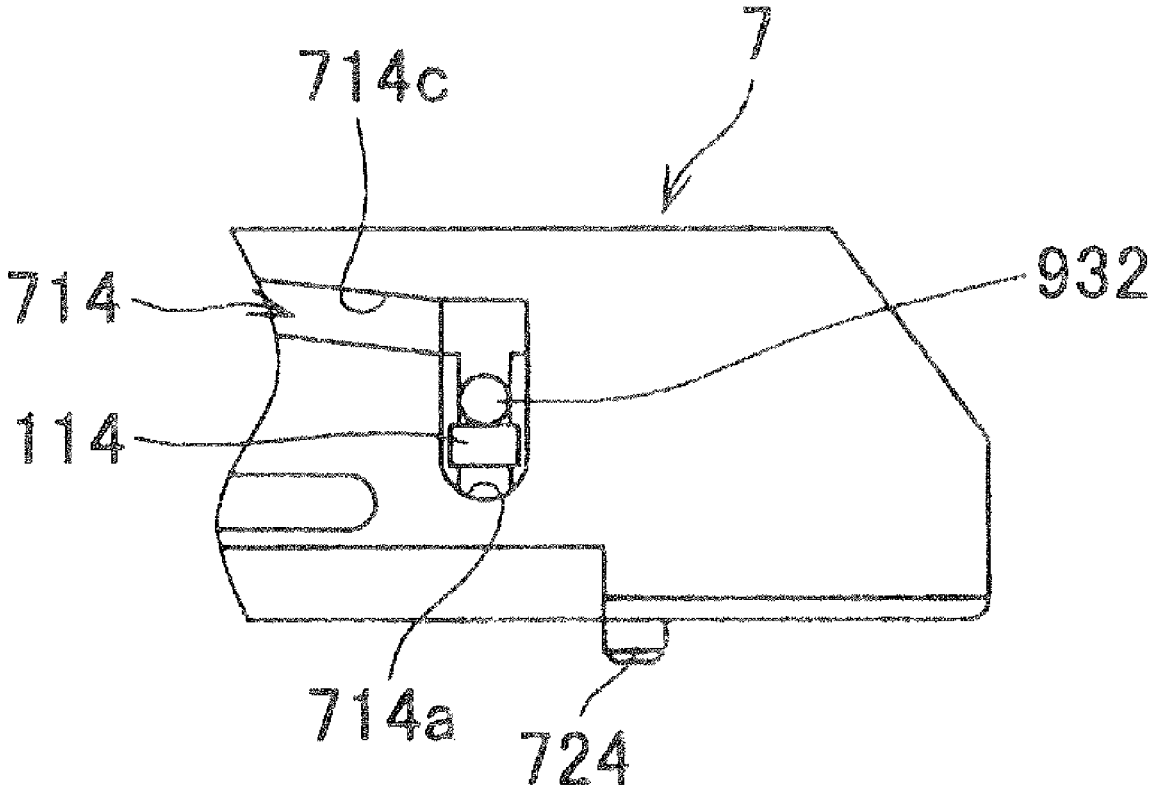
FIG. 18B is a view taken in the direction of the arrow B in FIG. 18A.
Figure 18C:
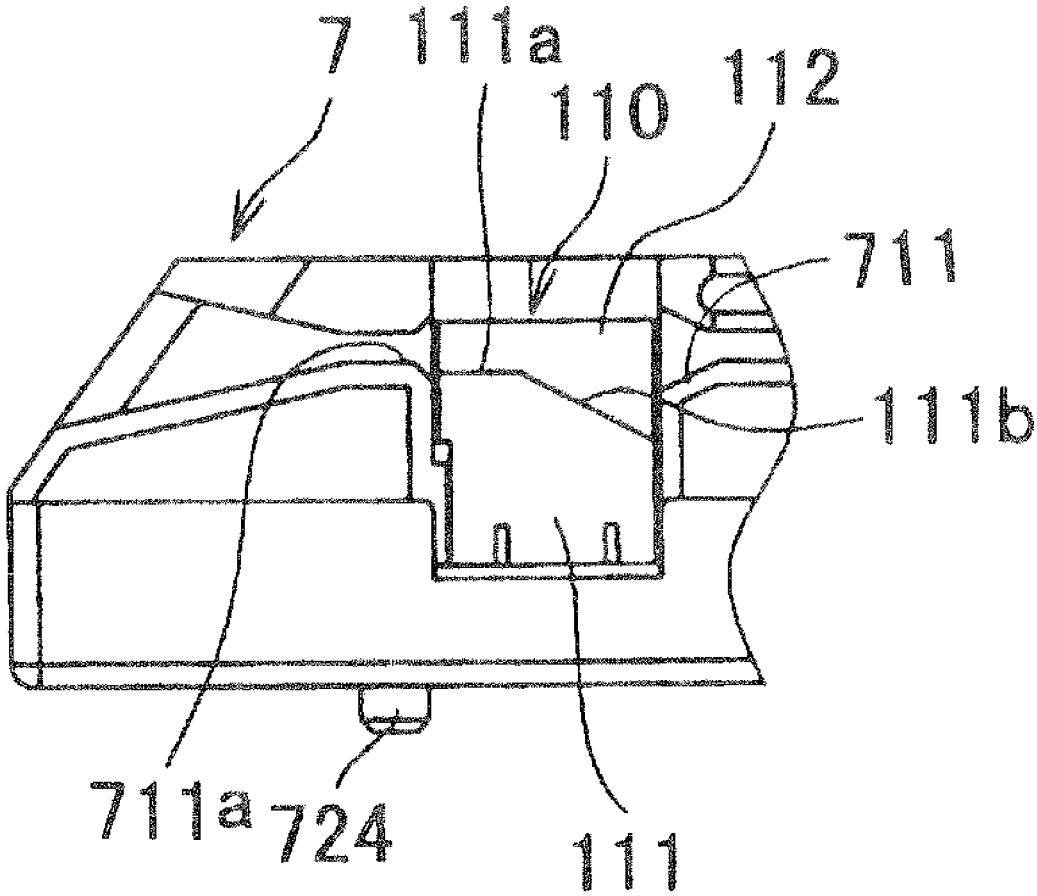
FIG. 18C is a view taken in the direction of the arrow C in FIG. 18A.
Figure 19:
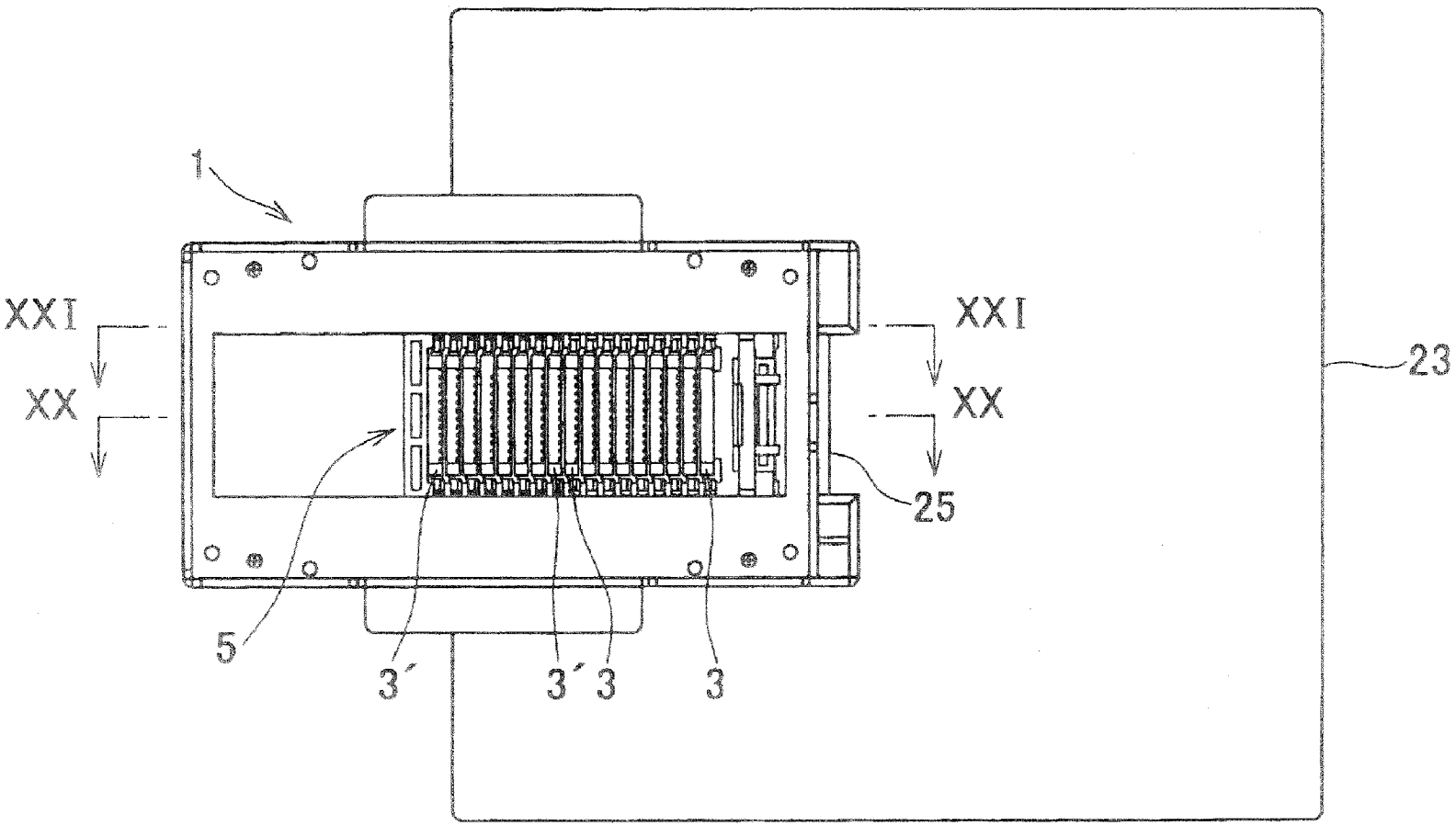
FIG. 19 is a bottom view of the object fitting/removing drive unit shown in FIG. 1 taken when the coupling member is inserted in the outer frames of the object fitting/removing drive unit, and the inner frame is in the initial position.

If the inner frame 5 is returned to the initial position e.g. by a manual operation, as shown in FIGS. 18A, 18B, and 18C, the bosses 932 of the shutter 93 are inserted in the associated vertical portions 714*a* of the guide grooves 714. Since the spring force of the spring 94 which urges the shutter 93 is stronger than the spring force of the spring 115 which urges the opening/closing member 110, each boss 932 pushes the associated boss 114 downward. This cases each opening/closing members 110 to be moved downward, and the main body 111 of each opening/closing member 110 which is in the upper position in the accommodating recess 712 is moved to the lower position in the accommodating recess 712. As a result, the entrance of each guide groove 711 is opened, whereby each guide groove 711 is ready to receive the associated flange 253 of the coupling member 25.

It should be noted that cables of the cable connectors are omitted in FIGS. 19 to 23, 25, and 26. Further, in FIGS. 20, 21, 22, and 23, the object fitting/removing drive unit 1 is viewed such that the substrate 23 is in a position above the inner frame 5.

Figure 20:
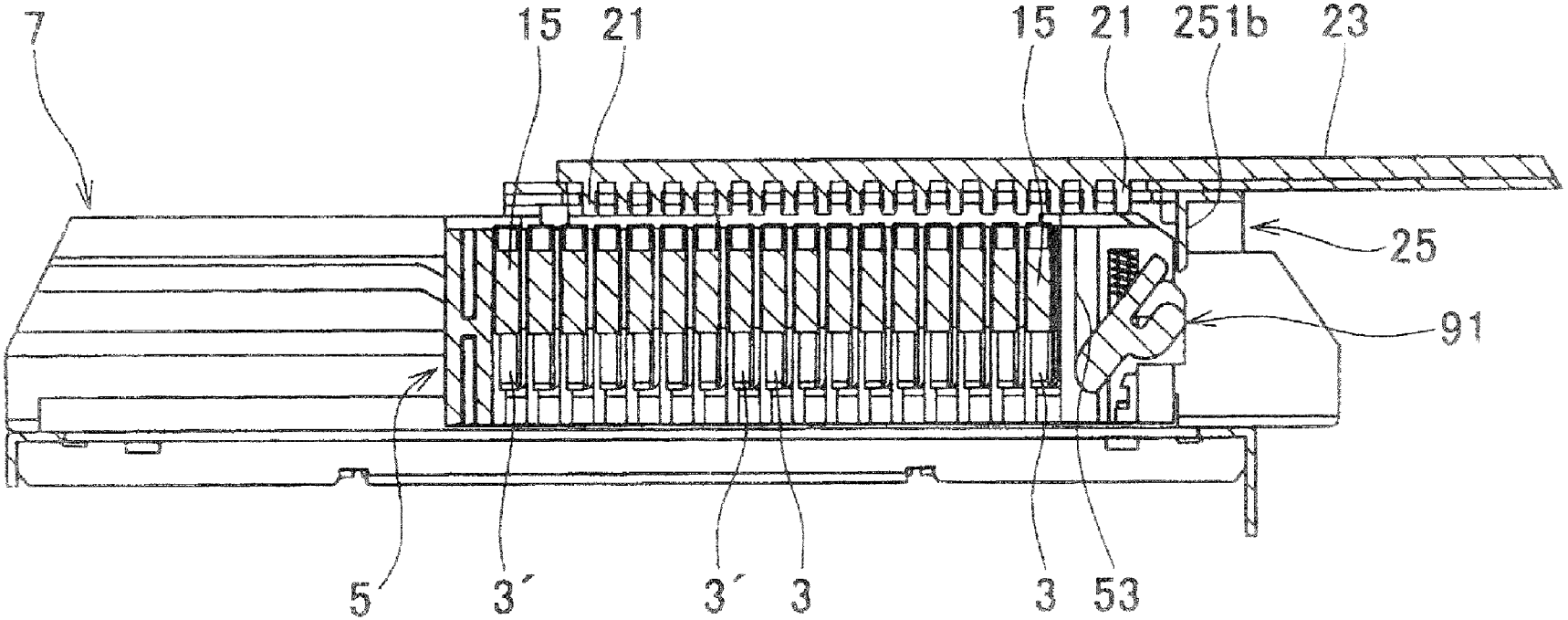
FIG. 20 is a cross-sectional view taken on line XX-XX in FIG. 19.
Figure 21:
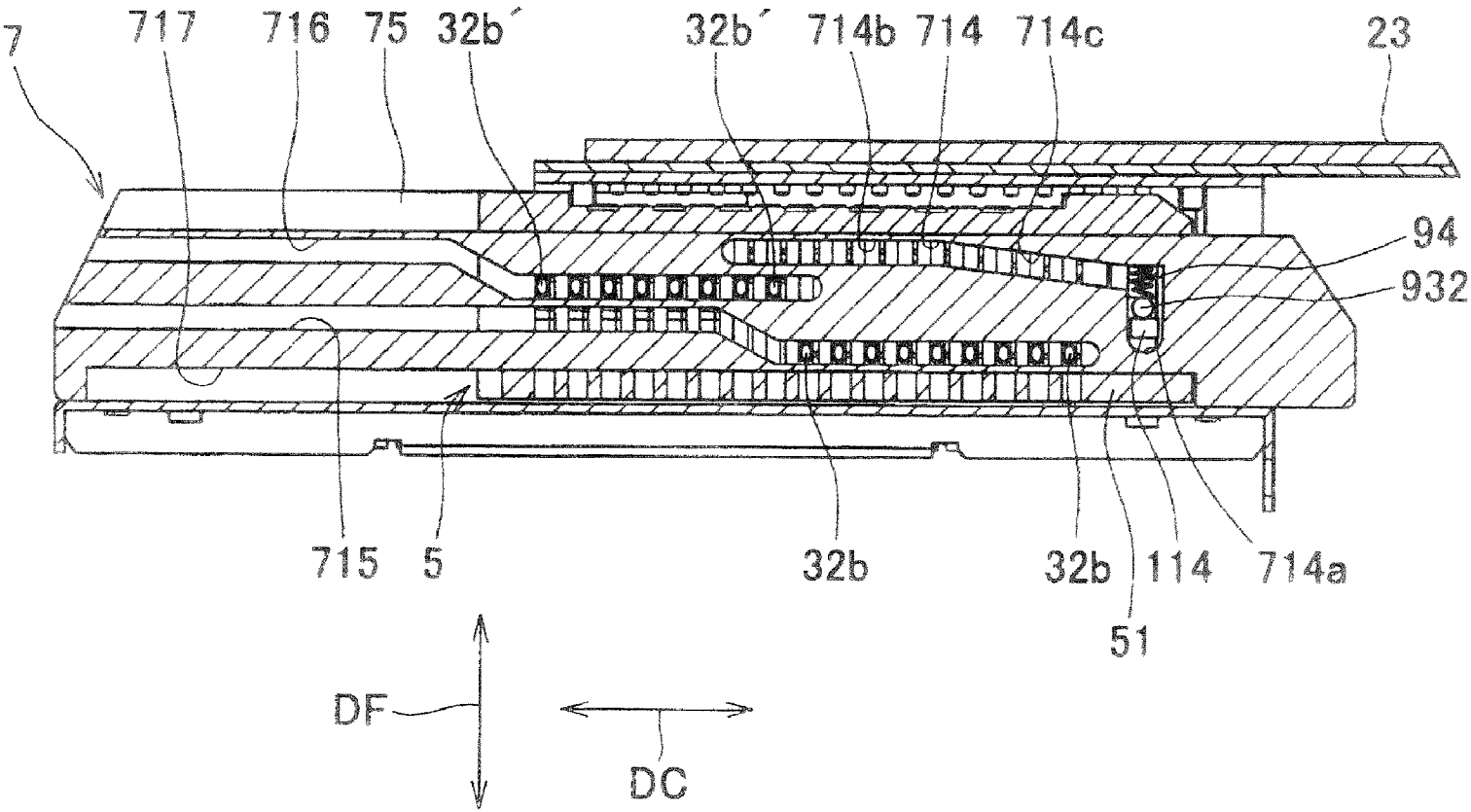
FIG. 21 is a cross-sectional view taken on line XXI-XXI in FIG. 19.

Next, a description will be given of fitting and removing operations of the cable connectors 15 to and from the header connectors 21 by the object fitting/removing drive unit 1. As shown in FIGS. 20 and 21, when the inner frame 5 is in the initial position, the bosses 932 of the shutter 93 are inserted in the associated vertical portions 714*a* of the guide grooves 714, and push the bosses 114 of the opening/closing members 110 downward by the spring forces of the springs 94 against the spring forces of the springs 115. When the bosses 932 are moved downward, the spring pins 92 (see FIG. 2) of the link 91 are pushed downward by the guide holes 935 (see FIG. 2) of the shutter 93, and the link 91 is pivoted in a clockwise direction about its lower end thereof, as shown in FIG. 20.

When the inner frame 5 is in the initial position, the bosses 32*b* and 32*b*' of the operation members 3 and 3' are below the cam grooves 715 and 716. At this time, the cable connectors 15 are most remote from the respective associated header connectors 21.

Figure 22:
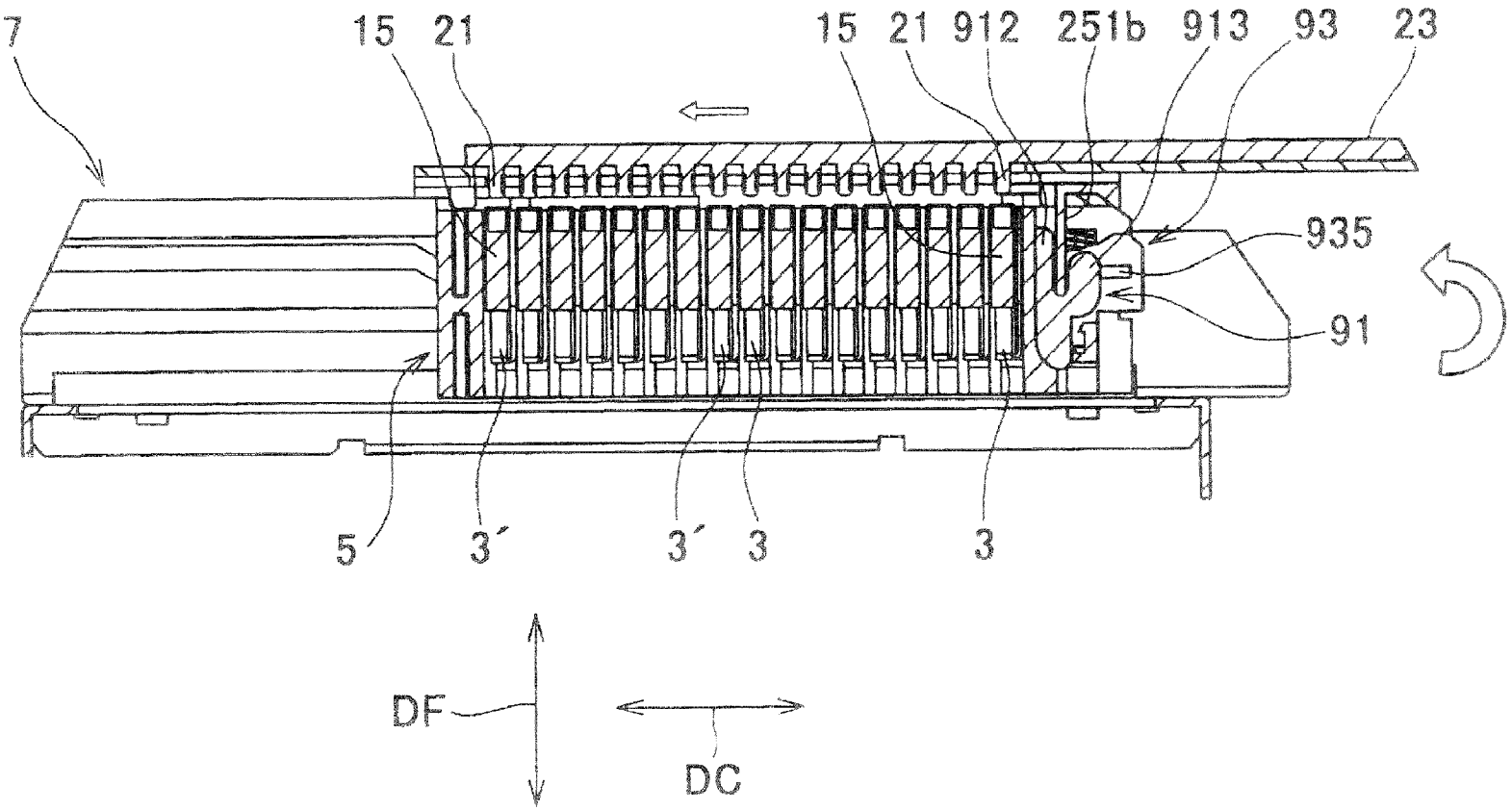
FIG. 22 is a cross-sectional view taken on the same cutting plane line as FIG. 20, when a link is pivoted by the coupling member.
Figure 23:
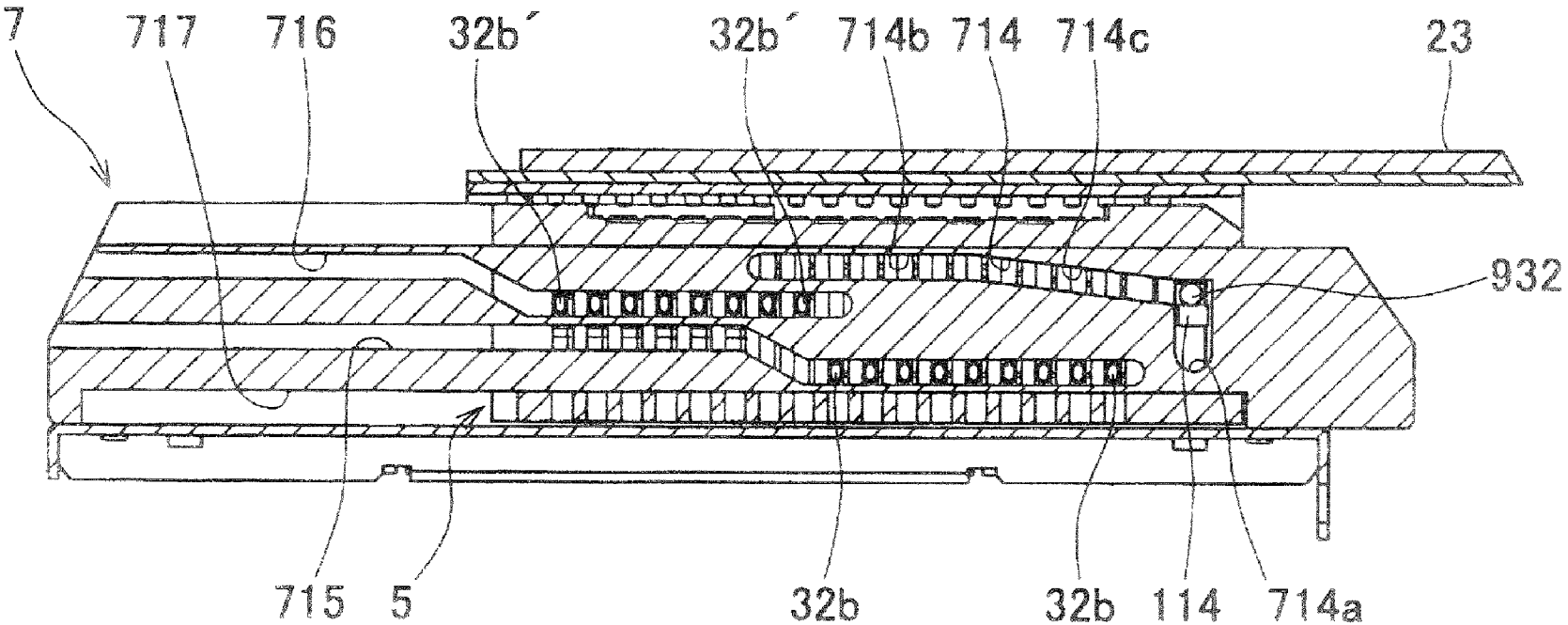
FIG. 23 is a cross-sectional view taken on the same cutting plane line as FIG. 21, when the link is pivoted by the coupling member.

As shown in FIGS. 22 and 23, when the first projecting piece 912 of the link 91 is pressed by the pressing piece 251*b* (see FIG. 24B) of the coupling member 25, the link 91 is pivoted in an anticlockwise direction. At this time, the spring pins 92 of the link 91 push the shutter 93 upward via the guide holes 935. As a result, the bosses 932 of the shutter 93 move upward against the spring forces of the springs 94, through the vertical portions 714*a* of the guide groove 714, into the inclined portions 714*c*.

Figure 24A:
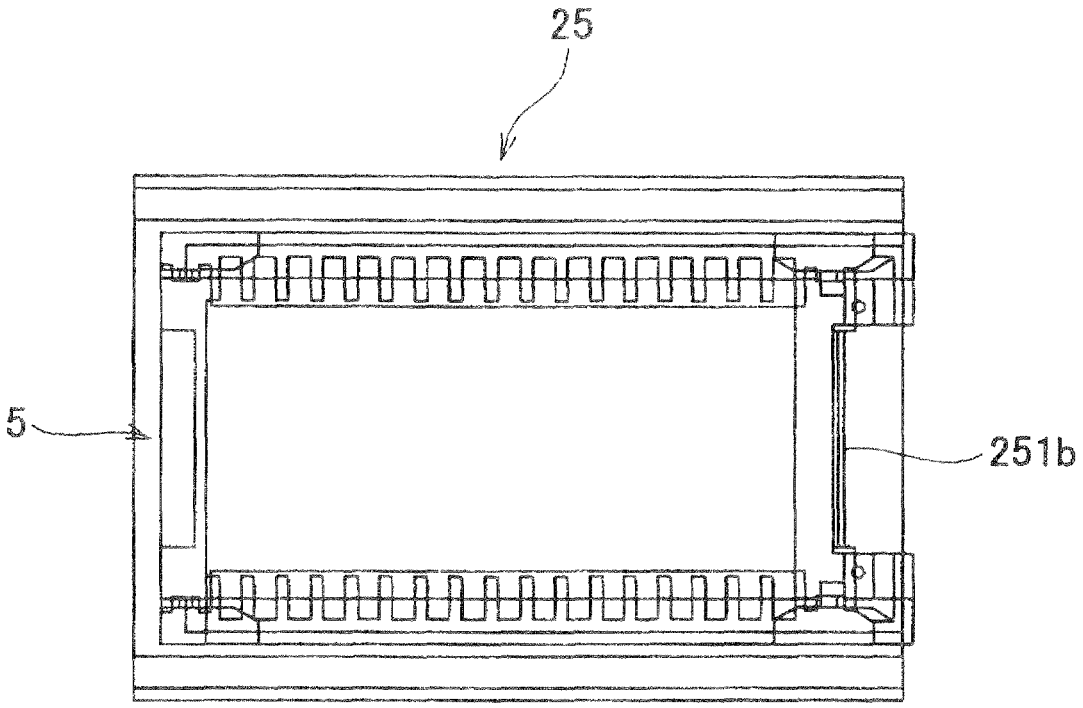
FIG. 24A is a schematic plan view of the coupling member and the inner frame in a state in which the former is brought into abutment with the latter.
Figure 24B:
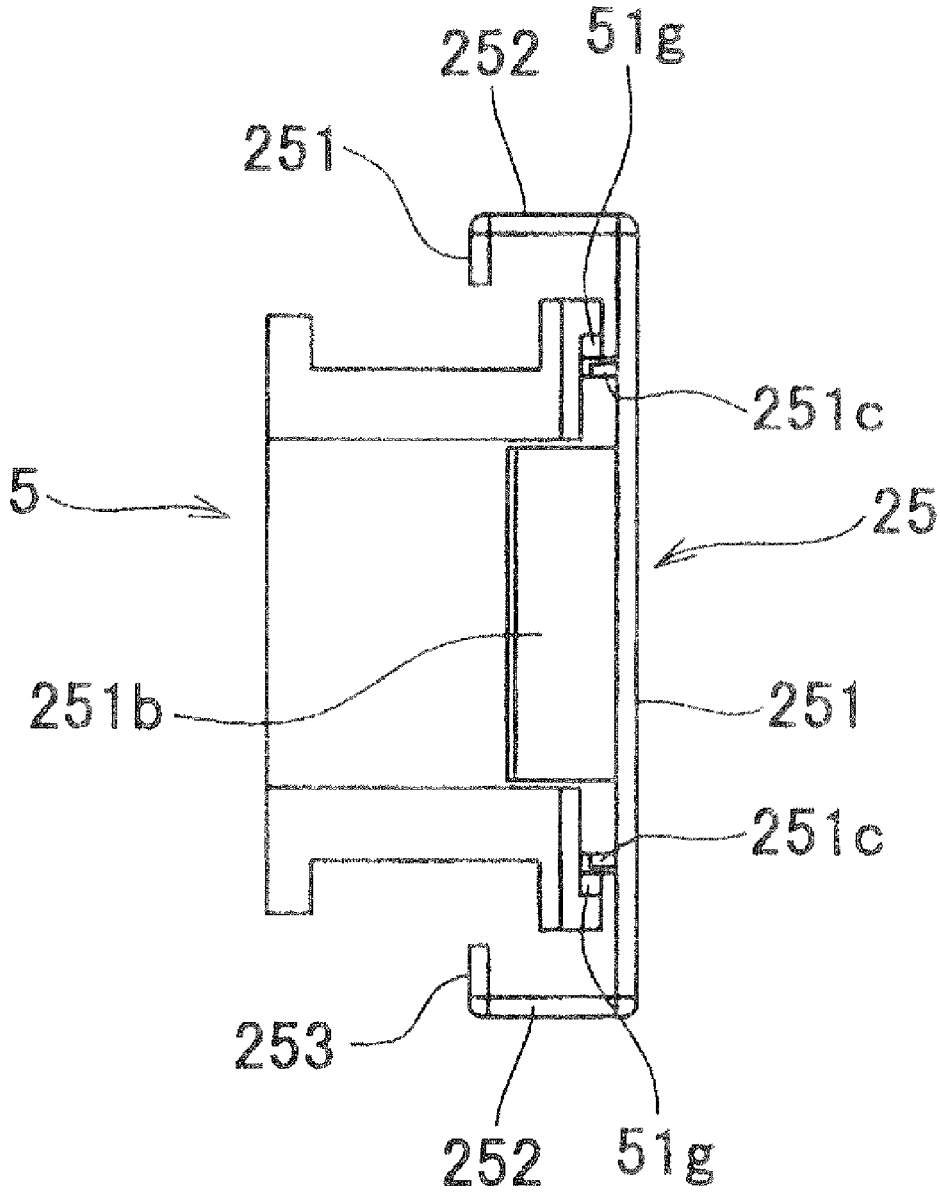
FIG. 24B is a schematic front view of the same.

At this time, as shown in FIGS. 24A and 24B, each bent piece 251*c* of the coupling member 25 is engaged with a surface of the protrusion 51*f* of the inner frame 5 opposite to the surface formed with the cutout 51*g*, which positions the coupling member 25 with respect to the inner frame 5 in a direction orthogonal to the fitting/removing direction DF and the connector arranging direction DC.

Figure 25:
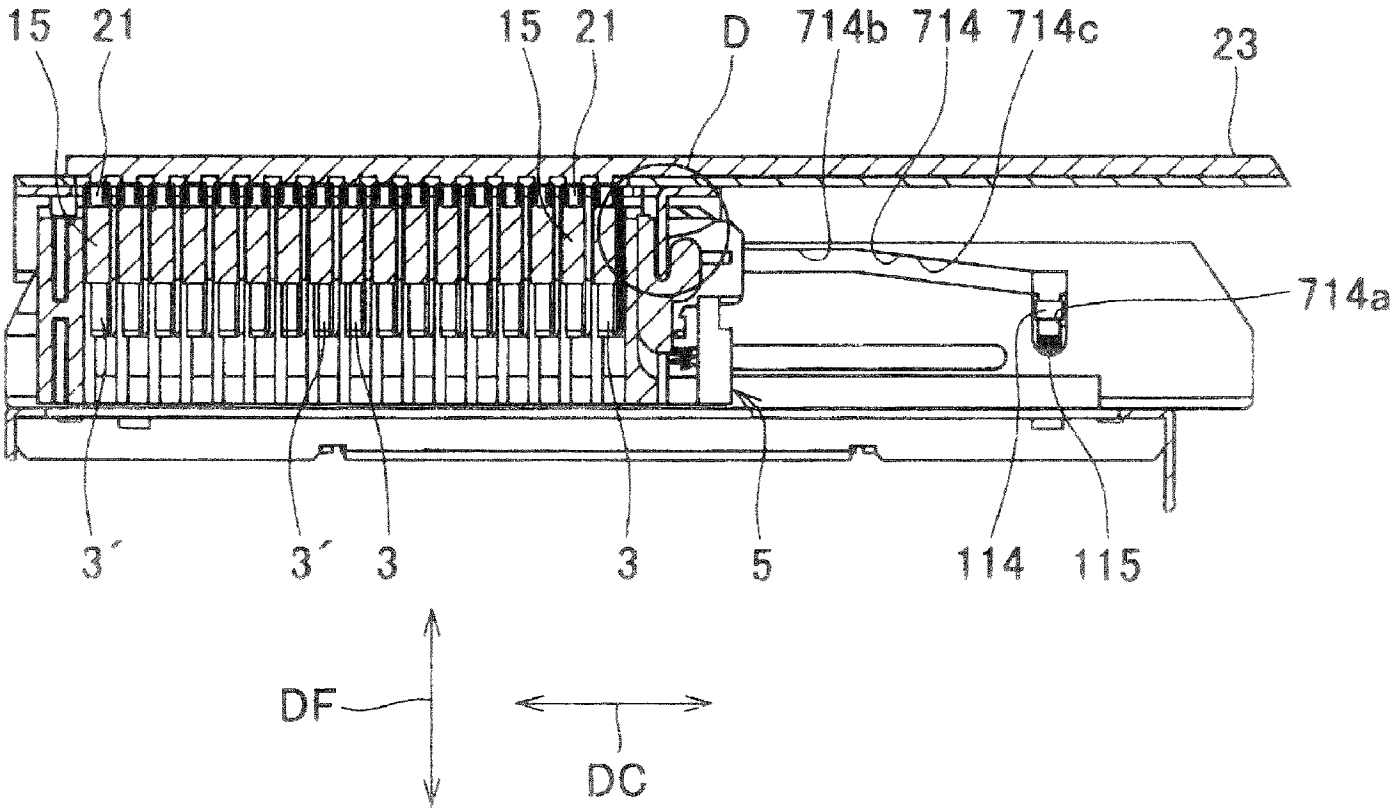
FIG. 25 is a cross-sectional view taken on the same cutting plane line as FIG. 20 when the inner frame is in the fitting-completed position.
Figure 26:
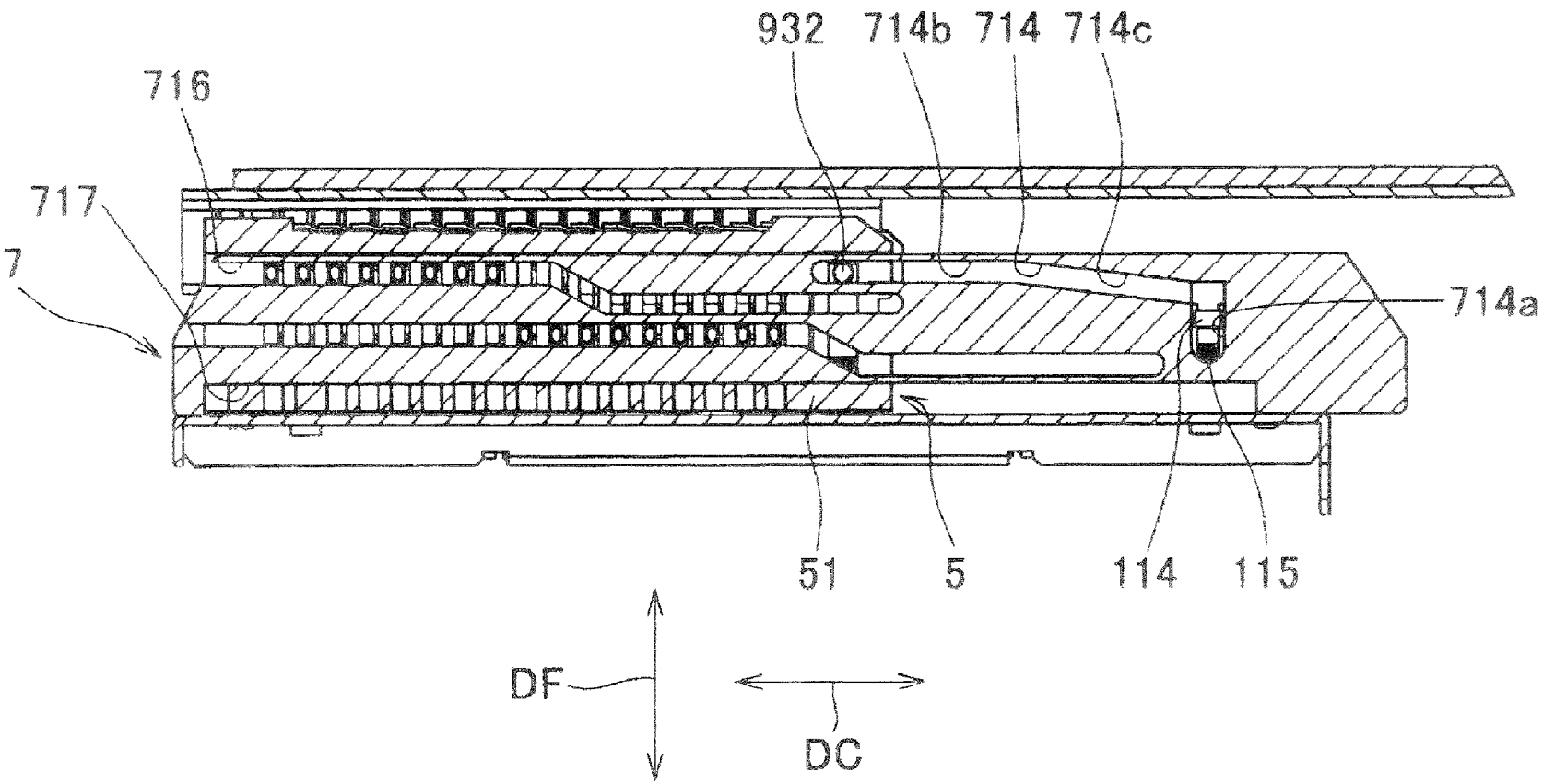
FIG. 26 is a cross-sectional view taken on the same cutting plane line as FIG. 21 when the inner frame is in the fitting-completed position.

As shown in FIGS. 25 and 26, when the inner frame 5 is moved to the fitting-completed position, the bosses 32*b* and 32*b*' of the operation members 3 and 3' are moved to respective high positions in the cam grooves 715 and 716. The operation members 3 and 3' are moved toward the header connectors 21 along the fitting/removing direction DF, and the cable connectors 15 and the header connectors 21 are fitted to each other.

Figure 27:
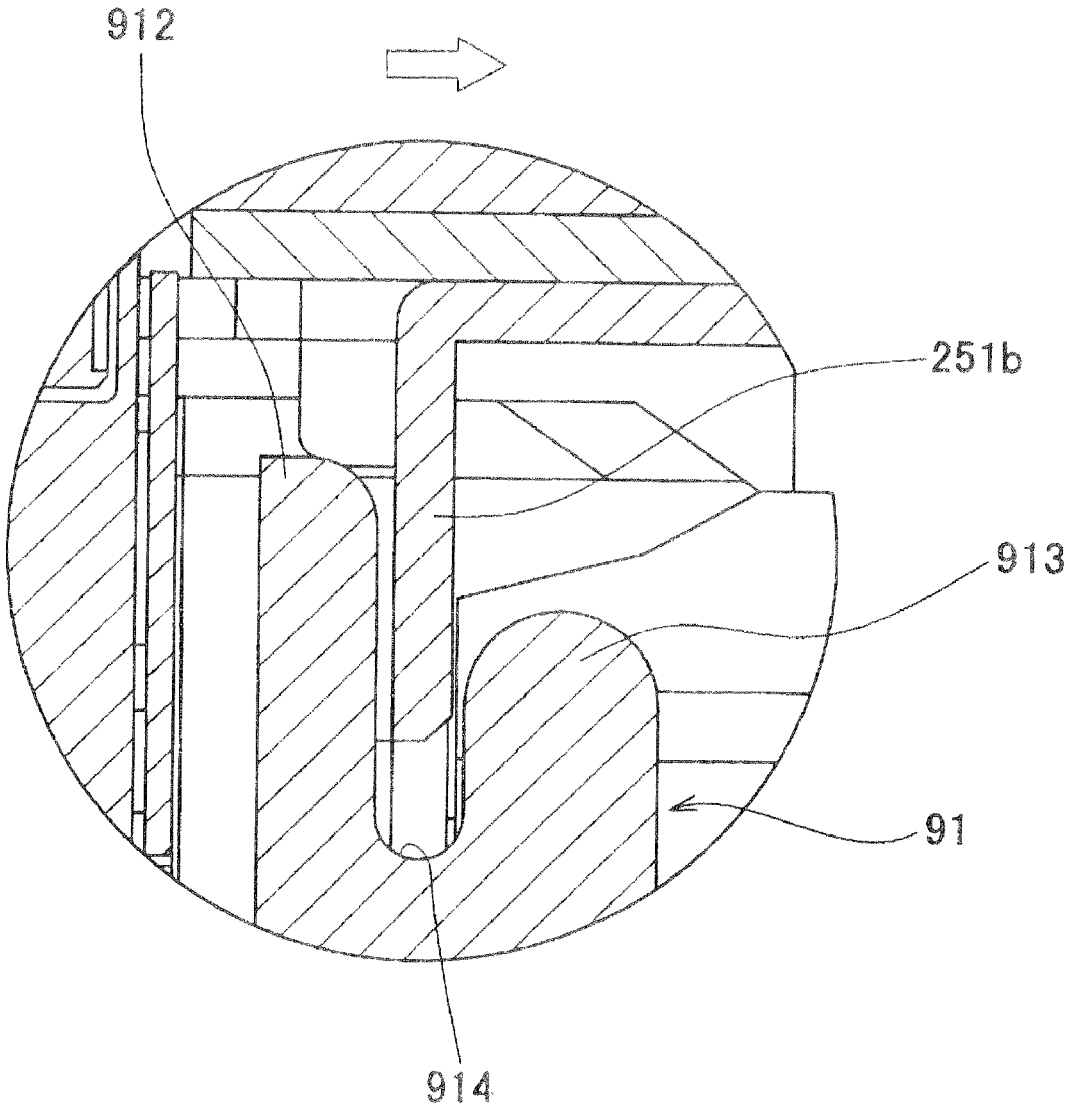
FIG. 27 is an enlarged view of a part D appearing in FIG. 25.

To remove the cable connectors 15 and the header connectors 21, it is only required to pull the substrate 23 in a direction of an arrow shown in FIG. 27.

When the inner frame 5 is moved in the direction of the arrow shown in FIG. 27, whereby the bosses 932 of the shutter 93 enter the associated inclined portions 714*c* of the guide grooves 714, the bosses 932 are progressively guided downward by the inclined portions 714*c*. The pressing piece 251*b* and the shutter 93 are engaged with each other during this time, and hence the force of pulling the substrate 23 is transferred to the inner frame 5.

When the bosses 932 enter the associated vertical portions 714*a* of the guide grooves 714, the bosses 932 are moved downward therein by the spring forces of the springs 94, whereby the pressing piece 251*b* and the shutter 93 are disengaged from each other, which causes the pressing piece 251*b* to move out of the accommodating space 914 of the link 91. When the bosses 932 are moved downward in the guide groove 714, the spring pins 92 of the link 91 are pressed downward by the inner surface of the guide holes 935 of the shutter 93, causing the link 91 to be pivoted in a clockwise direction about its lower end, whereby the inner frame 5 is returned to the initial position.

As described above, according to the object fitting/removing drive unit 1 according to the present embodiment, by moving the inner frame 5 in a direction orthogonal to the fitting/removing direction DF by the coupling member 25, it is possible to fit and remove the cable connectors 15 and the head connectors 21 to and from each other.

Therefore, when the cable connectors 15 and the header connectors 21 are fitted and removed to and from each other, even if there is not enough working space in the fitting/removing direction DF, it is possible to fit and remove the cable connectors 15 and the head connectors 21 to and from each other.

Further, the coupling member 25 in the fitting/removing direction DF can be positioned by inserting the flanges 253 of the coupling member 25 in the guide grooves 711 of the outer frames 7. Therefore, it is possible to perform accurate positioning of the header connectors 21 in the fitting/removing direction DF.

Further, the outer frames 7 are each formed with the first and second cam grooves 715 and 716. This makes it possible to reduce the length and the sliding distance of each outer frame 7.

It should be noted that although in this embodiment, the abnormal fitting prevention device 11 having the opening/closing member 110 is employed as the abnormal fitting preventing structure, the abnormal fitting preventing structure is not limited to the abnormal fitting prevention device 11. Further, there is no need to employ the abnormal fitting preventing structure.

Further, although in this embodiment, the coupling member 25 and the header connectors (the other object to be connected) 21 are separated, the coupling member may be integrated with the other object to be connected.

It should be noted that although in this embodiment, the base plate 13 is employed, the base plate 13 is not necessarily required, but the inner frame 5 and the outer frames 7, or the like, may be directly mounted on the panel.

Further, although the object fitting/removing drive unit 1 according to the above-described embodiment is employed for fitting and removing the connectors to and from each other, the object fitting/removing drive unit according to the present invention can also be employed to fit and remove the objects to be connected other than the connectors to and from each other.

It should be noted that the object fitting/removing drive unit 1, the cable connectors 15, and the header connectors 21 form a connector unit.

It is further understood by those skilled in the art that the foregoing are the preferred embodiments of the present invention, and that various changes and modification may be made thereto without departing from the spirit and scope thereof.

What is claimed is:

1. An object fitting/removing drive unit for fitting and removing one object to be connected and another object to be connected to and from each other, comprising:

at least one operation member that has a holding frame which holds the one object to be connected;

a coupling member which is coupled with the other object to be connected;

an inner frame that accommodates said operation member in a manner movable in a fitting/removing direction;

an outer frame that supports said inner frame along a direction which is orthogonal to the fitting/removing direction in a manner movable between an initial position and a fitting-completed position, and supports said coupling member in a manner movable along the direction which is orthogonal to the fitting/removing direction, for guiding said operation member toward the other object to be connected to fit the one object to be connected to the other object to be connected, when said inner frame is moved from the initial position to the fitting-completed position by being pushed by said coupling member; and driving force-transferring means for transferring a driving force in the direction which is orthogonal to the fitting/removing direction, to said inner frame.

2. An object fitting/removing drive unit as claimed in claim 1, wherein said outer frame includes a guide groove which guides said coupling member in a direction which is orthogonal to the fitting/removing direction.

3. An object fitting/removing drive unit as claimed in claim 2, further comprising an abnormal fitting-prevention structure which prevents said coupling member from moving into the guide grooves, when said inner frame is not in the initial position.

4. An object fitting/removing drive unit as claimed in claim 3, wherein said abnormal fitting-prevention structure comprises:

an opening/closing member which is provided on said outer frame, and opens/closes one end of the guide groove, and a driving member which is provided on said inner frame, and is engaged with said opening/closing member to open the one end of the guide groove when said inner frame is in the initial position, and is disengaged from said opening/closing member to close the one end of the guide groove when said inner frame is not in the initial position.

5. A connector unit having one connector, another connector which is capable of being fitted to the one connector, and an object fitting/removing drive unit for fitting/removing both the connectors comprising:

at least one operation member that has a holding frame which holds the one connector;

a coupling member which is coupled with the other connector;

an inner frame for accommodating said operation member movably in the fitting/removing direction;

an inner frame that accommodates said operation member in a manner movable in a fitting/removing direction;

an outer frame that supports said inner frame along a direction which is orthogonal to the fitting/removing direction in a manner movable between an initial position and a fitting-completed position, and supports said coupling member in a manner movable along the direction which is orthogonal to the fitting/removing direction, for guiding said operation member toward the other connector to fit the one connector to the other connector, when said inner frame is moved from the initial position to the fitting-completed position; and driving force-transferring means for transferring a driving force in the direction which is orthogonal to the fitting/removing direction, to said inner frame.

6. A connector unit as claimed in claim 5, wherein said outer frame includes a guide groove for guiding said coupling member in a direction which is orthogonal to the fitting/removing direction.

7. A connector unit as claimed in claim 6 further comprising an abnormal fitting-prevention structure which prevents said coupling member from moving into the guide grooves, when said inner frame is not in the initial position.

8. A connector unit as claimed in claim 7, wherein said abnormal fitting-prevention structure comprises:

an opening/closing member which is provided on said outer frame, and opens/closes one end of the guide groove, and a driving member which is provided on said inner frame, and is engaged with said opening/closing member to open the one end of the guide groove when said inner frame is in the initial position, and is disengaged from said opening/closing member to close the one end of the guide groove when said inner frame is not in the initial position.

* * * * *